US006458012B1

(12) United States Patent
Hirokawa et al.

(10) Patent No.: US 6,458,012 B1
(45) Date of Patent: Oct. 1, 2002

(54) POLISHING APPARATUS

(75) Inventors: Kazuto Hirokawa, Chigasaki; Hirokuni Hiyama, Tokyo; Yutaka Wada, Chigasaki; Hisanori Matsuo, Fujisawa; Tetsuji Togawa, Chigasaki, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/612,215

(22) Filed: Jul. 7, 2000

(30) Foreign Application Priority Data

Jul. 7, 1999 (JP) ..... 11-193300

(51) Int. Cl.[7] ..... B24B 49/00

(52) U.S. Cl. ..... 451/5; 451/10; 451/41; 451/60; 451/286; 451/287; 451/288

(58) Field of Search ..... 451/5, 10, 41, 451/60, 286, 287, 288, 289

(56) References Cited

U.S. PATENT DOCUMENTS 5,738,574 A 4/1998 Tolles et al.
5,804,507 A 9/1998 Perlov et al.

FOREIGN PATENT DOCUMENTS

EP 0 928 662 A2 7/1999
JP 11-204468 7/1999

*Primary Examiner*—Joseph J. Hail, III
*Assistant Examiner*—Shantese McDonald
(74) *Attorney, Agent, or Firm*—Wenderoth, Lind & Ponack, L.L.P.

(57) ABSTRACT

A polishing apparatus is used for polishing a surface of a workpiece such as a semiconductor wafer or a glass substrate. The polishing apparatus comprises a polishing table having a polishing surface thereon, a plurality of workpiece holders each for holding a workpiece and pressing the workpiece against the polishing surface, and a controller for controlling the workpiece holders individually so that polishing operations of the workpiece holders are controlled independently of each other.

21 Claims, 16 Drawing Sheets

POLISHING APPARATUS

BACKGROUND OF THE INVENTION

1. Field of the Invention

The present invention relates to a polishing apparatus for polishing a plate-like workpiece such as a semiconductor wafer or a glass substrate.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Although the photolithographic process can form interconnections that are at most 0.5 $\mu$m wide, it requires that surfaces of semiconductor wafers on which pattern images are to be focused by a stepper be as flat as possible because the depth of focus of the optical system is relatively small. It is therefore necessary to planarize the surfaces of the semiconductor wafers for photolithography. One customary way of planarizing the surfaces of the semiconductor wafers is to polish them with a polishing apparatus.

FIG. 17 of the accompanying drawings shows a main part of a conventional polishing apparatus. The polishing apparatus comprises a rotating polishing table 100 with a polishing cloth 102 made of urethane or the like attached to an upper surface thereof, a top ring (workpiece holder) 104 for holding a semiconductor wafer W which is a workpiece to be polished and pressing the semiconductor wafer W against the polishing table 100 while the top ring 104 is rotated, and a polishing liquid supply nozzle 106 for supplying a polishing liquid Q to the polishing cloth 102. The top ring 104 is connected to a top ring shaft 110 through a spherical bearing 108 so that the top ring 104 is tiltable with respect to the top ring shaft 110. The top ring 104 is provided with an elastic pad 112 made of polyurethane or the like on its lower surface, and the semiconductor W is held by the top ring 104 in contact with the elastic pad 112. The top ring 104 also has a cylindrical guide ring 114 mounted on a lower outer circumferential edge thereof for retaining the semiconductor wafer W on the lower surface of the top ring 104.

In operation, the semiconductor wafer W is held against the lower surface of the elastic pad 112, and pressed against the polishing cloth 102 on the polishing table 100 by the top ring 104. The polishing table 100 and the top ring 104 are rotated to move the polishing cloth 102 and the semiconductor wafer W relatively to each other. At this time, the polishing liquid Q is supplied onto the polishing cloth 102 from the polishing liquid supply nozzle 106. The polishing liquid Q comprises a chemical solution such as an alkali solution containing abrasive particles suspended therein. The semiconductor wafer W is polished by a composite action comprising a chemical polishing action of the chemical solution and a mechanical polishing action of the abrasive particles. This polishing is called chemical mechanical polishing.

In the chemical mechanical polishing (CMP) apparatus using the polishing cloth 102, since the polishing cloth 102 is made of material having elasticity, irregularities of a polished surface of the semiconductor wafer remain, and the surface of the semiconductor wafer cannot be sufficiently planarized. Therefore, the conventional CMP apparatus cannot cope with a demand for a higher degree of planarization of the semiconductor wafer.

To be more specific, a device pattern on the upper surface of the semiconductor wafer W has various irregularities having various dimensions and steps. When the semiconductor wafer W having step-like irregularities is planarized by the polishing cloth 102 having elasticity, not only raised regions but also depressed regions are polished, and hence irregularities of the polished surface of the semiconductor wafer are difficult to be eliminated, with the result that a high degree of flatness of the polished surface cannot be obtained.

Further, the surface of the polishing cloth 102 tends to have irregularities, and hence it is necessary to perform dressing of the surface of the polishing cloth 102 frequently for thereby removing glazing of the surface of the polishing cloth 102.

Furthermore, a considerable proportion of the polishing liquid Q supplied to the polishing cloth 102 is discharged without reaching the surface of the semiconductor wafer to be polished. Consequently, the polishing liquid Q is required to be supplied in a large quantity, and hence an operating cost of the polishing process becomes high because the polishing liquid is expensive and the cost of a process for treating the polishing drain liquids high.

Therefore, there has been developed a fixed abrasive type polishing apparatus and method in which a polishing surface comprising an abrading plate, i.e. a fixed abrasive plate is used, in place of the polishing cloth 102. The abrading plate comprises abrasive particles such as silica particles and a binder for binding the abrasive particles, and is formed into a flat plate. FIG. 18 shows a main part of a conventional polishing apparatus having such abrading plate. The polishing apparatus comprises a polishing table 100 with a polishing tool 120 attached to an upper surface thereof, and liquid supply nozzles 124 connected to a liquid supply device 122 for supplying water or a chemical liquid during polishing. The polishing tool 120 attached to the upper surface of the polishing table 100 comprises a base plate 116 and an abrading plate 118 attached to the surface of the base plate 116. Other structure of the polishing apparatus shown in FIG. 18 is the same as that of the conventional polishing apparatus shown in FIG. 17.

According to the above polishing process, the abrading plate (fixed abrasive) is harder than the polishing cloth and has less elastic deformation than the polishing cloth, and hence only the raised regions on the semiconductor wafer are polished and undulation of the polished surface of the semiconductor wafer is prevented from being formed. Therefore, selective polishing performance of the raised regions on the semiconductor wafer is improved, a degree of flatness of the semiconductor wafer is improved, and an expensive polishing liquid Q is not required to be used.

Further, it is confirmed by the inventors of the present application that in the polishing method using the fixed abrasive, the polished surface of the semiconductor wafer is planarized once to a certain level, and then the polishing rate is extremely lowered to show a self-stop ability of polishing because of the nature of the fixed abrasive. Therefore, the inventors of the present application have proposed to utilize such self-stop ability of polishing for detecting an endpoint of polishing or detecting a thickness of a film formed on the semiconductor wafer W in Japanese patent application Nos. 10-150546 and 10-134432.

Recently, there have been strong demands of the polishing apparatus for polishing semiconductor wafers towards improvement of productivity per an apparatus and improvement of productivity per unit installation area of the apparatus, as in other semiconductor manufacturing apparatuses. However, in the polishing apparatus having a single top ring per a polishing table, the polishing surface on the polishing table is not effectively utilized, and therefore the productivity per unit installation area of the apparatus cannot be improved.

one solution is to provide a polishing apparatus with a plurality of holders each for holding a workpiece to be polished, the holders sharing a common polishing surface. Such a polishing apparatus is referred to as a multihead polishing apparatus. The multihead polishing apparatus is advantageous in that it can simultaneously polish an increased number of workpieces per unit time. However, it is difficult for the multihead polishing apparatus to polish workpieces to a uniform finish because the simultaneously polished workpieces tend to be polished to different levels at the termination of the polishing process.

Inasmuch as a plurality of workpieces are simultaneously polished with the common polishing surface, if the number or the position of workpieces to be polished changes, then the forces applied to the common polishing surface also change, making it difficult to keep the common polishing surface at a desired attitude or posture. As a result, the workpieces cannot be polished as desired.

SUMMARY OF THE INVENTION

It is therefore an object of the present invention to provide a polishing apparatus which is capable of increasing the throughput of the workpieces per unit installation area in a clean room requiring an expensive operating cost with keeping uniformity and quality of polished surfaces of the workpieces.

According to an aspect of the present invention, there is provided a polishing apparatus for polishing a surface of a workpiece, comprising: a polishing table having a polishing surface thereon; a plurality of workpiece holders each for holding a workpiece and pressing the workpiece against the polishing surface; and a controller for controlling the workpiece holders individually so that polishing operations of the workpiece holders are controlled independently of each other.

Since a plurality of workpieces can simultaneously be polished on one polishing table, the throughput per unit installation area can greatly be increased. Furthermore, because the process of polishing the workpieces is individually controlled by the controller, the workpieces can uniformly be polished to a desired level without being polished excessively or insufficiently by individually controlling the process of polishing the individual workpiece. Elements that can be controlled for controlling the polishing process include a polishing time, a polishing pressure, a relative sliding speed between the workpiece and the polishing surface, etc.

The controller may control the workpiece holders so as to be individually movable into and out of contact with the polishing surface.

Inasmuch as the workpiece holders can be moved into and out of contact with the polishing surface independently of each other for individually controlling the polishing times of the workpieces based on a suitable parameter, it is possible to cancel out differences between the polishing characteristics of the workpieces to eliminate variations in the workpieces and to polish the workpieces as required.

The motion of the polishing table within the predetermined plane may be a rotary motion as of a turntable or a scroll motion referred to as a circulative translational motion, which may be selected depending on the purpose of the polishing process.

The apparatus may further comprise a detecting device associated with each of the workpiece holders, for detecting condition of the workpiece which is being polished by the workpiece holder.

Various parameters may be detected as heretofore proposed. For example, if the polishing surface is a fixed abrasive surface which causes self-generation of abrasive particles, then its self-stop ability may be used to perform a simple control process by detecting a sliding torque between the workpieces and the polishing table.

The detecting device may detect formation of a liquid film between the workpiece and the polishing surface.

The apparatus may further comprise a transfer device for transferring workpieces to and from the workpiece holders. If the transfer device can hold a workpiece, then the rate of operation increases for replacing workpieces.

The transfer device may transfer one of the workpieces to and from one of the workpiece holders.

Alternatively, the transfer device may transfer the workpieces all together to and from the workpiece holders.

The polishing table may have an unpolishing surface disposed inwardly of the polishing surface. If the polishing table comprises a turntable, then since the unpolishing surface has a weak polishing capability it may effectively be used to install a structure for supplying and discharging a polishing liquid or a temperature regulating heating medium, for example.

At least one of the workpiece holders may place the workpiece on a center of thee polishing table for polishing the workpiece. Therefore, the surface of the polishing table can effectively be utilized for an increased throughput. If the polishing table comprises a turntable, then the center of the polishing table has a weak polishing capability. However, the weak polishing capability poses no problem particularly if the polishing surface is a fixed abrasive surface because its self-stop ability is effective to produce uniformly polished surfaces on the workpieces.

According to still another aspect of the present invention, there is provided a polishing apparatus for polishing a surface of a workpiece, comprising: a polishing table having a polishing surface thereon, the polishing surface being made of a material which causes self-generation of an abrasive; and a plurality of workpiece holders each for holding a workpiece and pressing the workpiece against the polishing surface. Since the polishing surface is a fixed abrasive surface, its self-stop ability can be used when a certain level of flatness is achieved by the workpieces. If a plurality of workpieces having different polishing characteristics are polished for a period of time greater than a certain threshold value, then the levels to which the workpieces are polished converge to a certain value.

According to yet another aspect of the present invention, there is provided a polishing apparatus for polishing a surface of a workpiece, comprising: a polishing table having a polishing surface thereon; a plurality of workpiece holders each for holding a workpiece and pressing the workpiece against the polishing surface; and a noncontact bearing for supporting the polishing table in a noncontact manner while controlling an attitude thereof. Even if the workpiece holders are individually brought into and out of contact with the polishing surface and hence the load on the polishing table is locally changed, the polishing table can be maintained at a constant attitude, allowing the workpieces to be polished well stably.

According to yet another aspect of the present invention, there is provided a polishing apparatus for polishing a surface of a workpiece, comprising: a polishing table having a polishing surface thereon; a plurality of workpiece holders each for holding a workpiece and pressing the workpiece against the polishing surface; and a noncontact bearing for supporting the polishing table in a noncontact manner while controlling an attitude thereof. Even if the workpiece holders are individually brought into and out of contact with the polishing surface and hence the load on the polishing table is locally changed, the polishing table can be maintained at a constant attitude, allowing the workpieces to be polished well stably.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
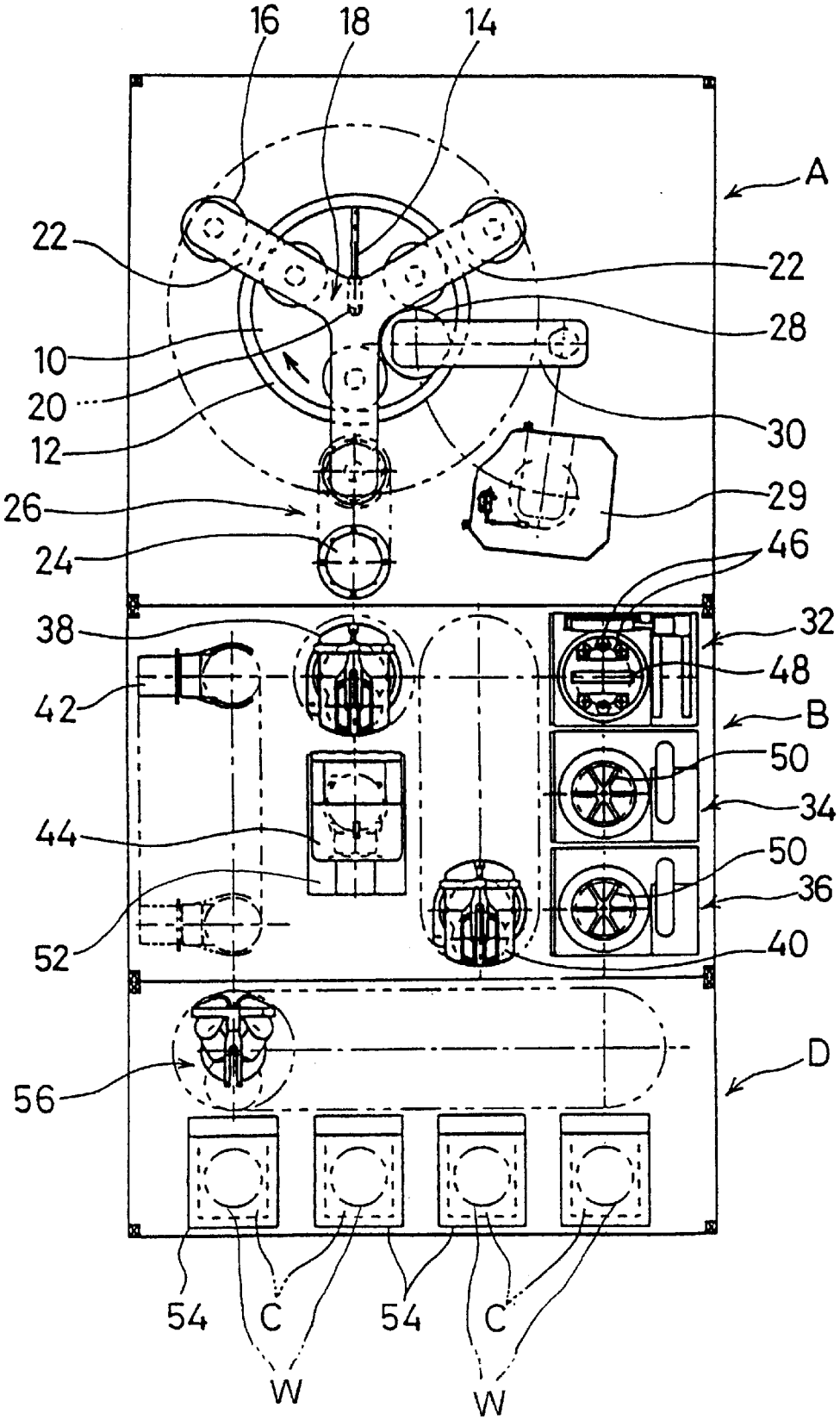
FIG. 1 is a plan view showing a polishing apparatus according to a first embodiment of the present invention.

Like or corresponding parts are denoted by like or corresponding reference characters throughout views.

FIG. 1 shows a polishing apparatus according to a first embodiment of the present invention. As shown in FIG. 1, the polishing apparatus has a polishing section A for polishing semiconductor wafers (substrate) W, a cleaning section B disposed in front of the polishing section A for cleaning and drying polished semiconductor wafers W, and a loading/unloading section D disposed in front of the cleaning section B and having wafer cassettes C for housing semiconductor wafers W that are to be polished and have been polished. Each of the polishing section A, the cleaning section B, and the loading/unloading section D is accommodated in a housing.

Figure 2:
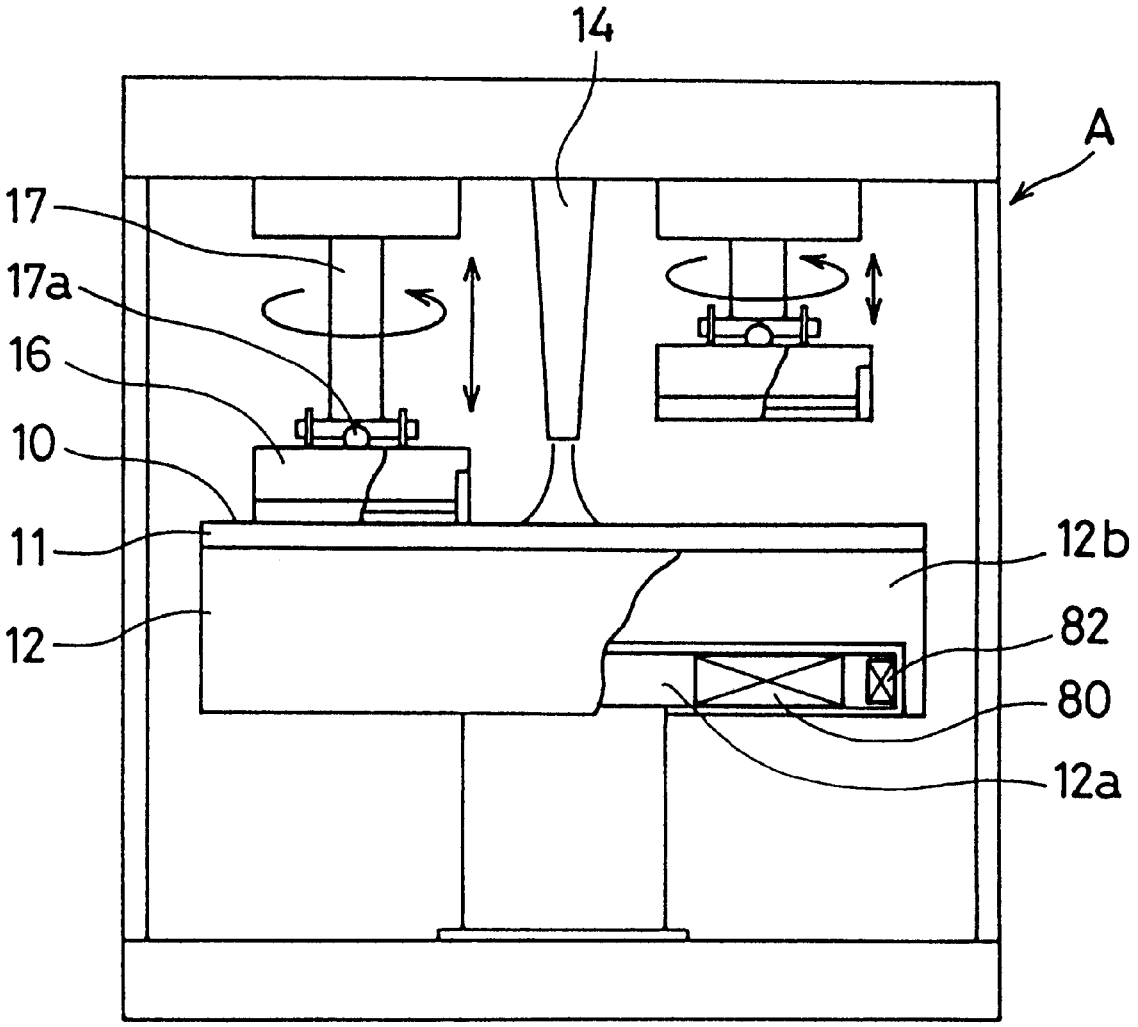
FIG. 2 is a partly broken front view showing the polishing apparatus shown in FIG. 1.
Figure 3:
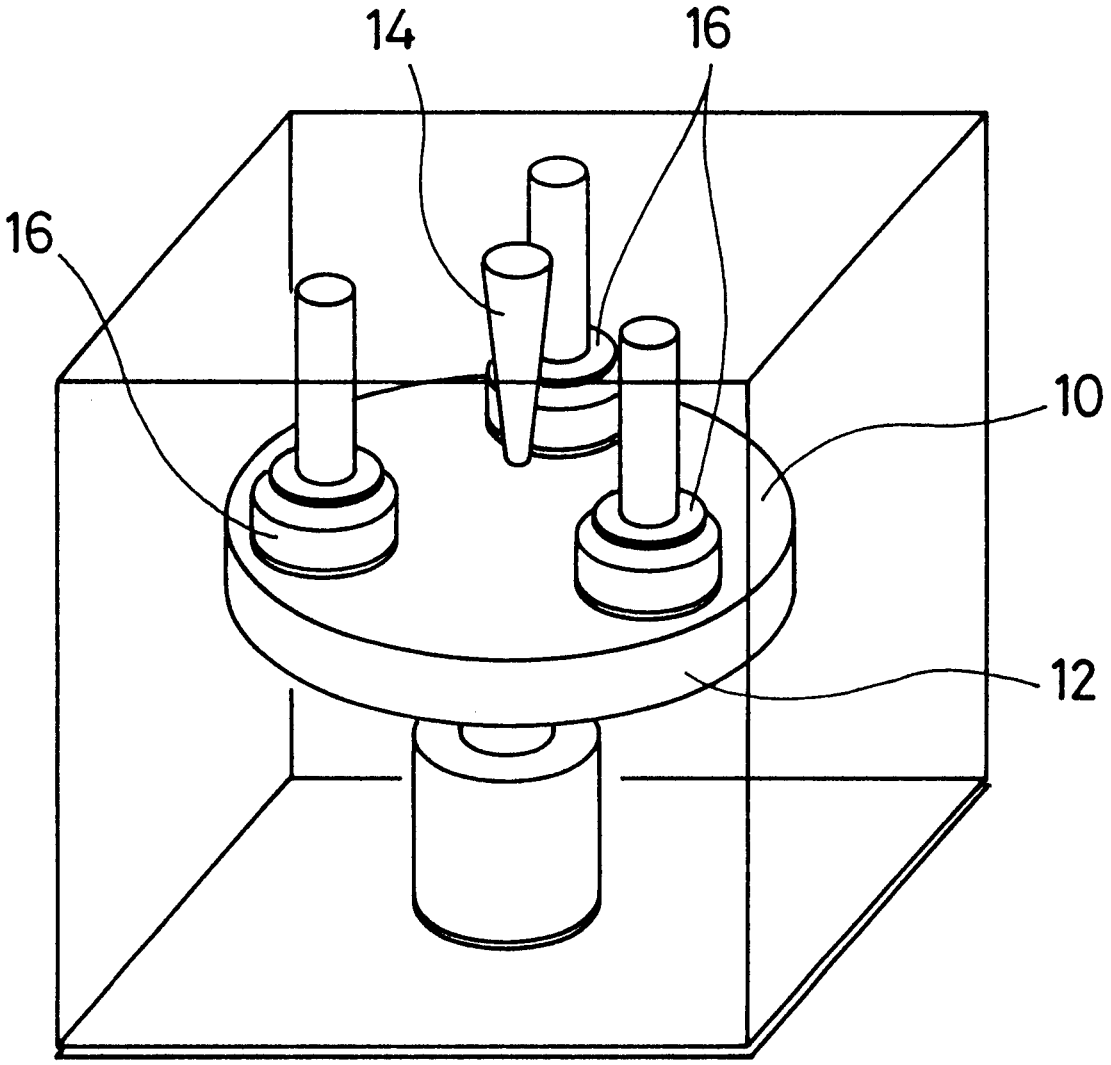
FIG. 3 is a schematic perspective view showing the polishing apparatus shown in FIG. 1.

As shown in FIGS. 2 and 3, the polishing section A has a polishing table 12 having a polishing surface 10 that is provided by an abrading plate (fixed abrasice plate) 11 mounted on the polishing table 12.

The polishing section A also has a liquid supply nozzle 14 disposed above the polishing table 12 and supported by a nozzle arm for supplying a polishing liquid or water to the polishing surface 10. Further ,the polishing section A has three top rings (substrate holders) 16 tiltably supported through a top ring shaft 17 and a spherical bearing 17*a* by a top ring support assembly 18 for holding semiconductor wafers W and keeping surfaces to be polished of the semiconductor wafers W in contact with the polishing surface 10 on the polishing table 12 for thereby polishing the semiconductor wafers W. The top ring support assembly 18 is rotatably and vertically movably supported on a support column 20 having an axis substantially aligned with an axis of the polishing table 12. The top ring support assembly 18 has three radial support arms 22 each supporting one of the top rings 16, a motor for rotating the top ring 16, and an air cylinder for vertically moving the top ring 16 and pressing the top ring 16 against the polishing table 12. The motors and air cylinders are connected to a controller (not shown) for controlling them so that the air cylinders can vertically move the top rings 16 independently of each other and also adjust their pressing pressures independently of each other. Further, the rotational speeds oft the motors are controlled independently of each other by the controller. Therefore, the top rings 16 are controlled individually to operate their polishing independently of each other.

The polishing section A also has a rotary transporter 26 (substrate transfer device) having two pushers 24 for attaching a semiconductor wafer W to and removing a semiconductor wafer W from a top ring 16. The rotary transporter 26 is rotatably supported by a support post at an intermediate position between the two pushers 24. When the support post rotates about its own axis, either one of the two pushers 24 can move selectively to a transfer position near the polishing table 12 and a transfer position near the cleaning section B.

As shown in FIG. 2, the polishing table 12 comprises a fixed plate 12*a* fixedly mounted on the upper end of a column and a movable late 12*b* movably mounted on the fixed plate 12*a* by a thrust magnetic bearing 80 and a radial magnetic bearing 82. The polishing table 121 is associated with sensors and a control mechanism for controlling the attitude (or posture) of the polishing table 12. In the first embodiment, each of the magnetic bearings comprises a combination of a bearing and a table actuator. Alternatively, a direct drive system may be employed in which a drive motor is directly coupled to the column.

Each of the top rings 16 or the support arm 22 has a moving mechanism for moving the top ring 16 along the support arm 22 radially across the polishing table 12. When the top ring 16 is thus moved, it can move selectively to a position above the polishing surface 10 and a position above the pusher 24 which is located in the transfer position near the polishing table 12. In FIG. 1, both oft the positions for the top ring 16 are illustrated.

The polishing section A further includes a dresser 28 for dressing the polish in surface 10 on the polishing table 12. The dresser 28 is mounted on one end of a dresser arm 30. When the dresser arm 30 is swung about a shaft on the other end thereof, the dresser 28 can move between a dressing position on the polishing surface 10 and a standby position outside of the polishing table 12. A cleaning container 29 which stores a cleaning liquid for cleaning the dresser 28 is disposed in the standby position of the dresser 28.

The cleaning section B has three cleaning units 32, 34 and 36, two feed robots 38, 40, and two reversing machines 42, 44. The cleaning unit 32 has rollers 46 for holding the circumferential edge of a semiconductor wafer W and rotating the semiconductor wafer W at a relatively low speed, and sponge rolls 48 for cleaning both surfaces of the semiconductor wafer W while the semiconductor wafer W is rotating at the relatively low speed. The cleaning unit 34 has a holder 50 for holding a semiconductor wafer W and rotating the semiconductor wafer W at a relatively high speed, and applies a jet of cleaning liquid to both surfaces or a polished surface of the semiconductor wafer W to clean the semiconductor wafer W while the holder 50 is rotating at the relatively high speed. The cleaning unit 36 has a holder 50 for holding a semiconductor wafer W and rotating the semiconductor wafer W at a relatively high speed or a high speed, and cleans a polished surfaced of the semiconductor wafer W with a pencil-shaped sponge member while the holder 50 is rotating at the relatively high speed, after which the semiconductor wafer W is rotated at the high speed to dry the semiconductor wafer W by way of a spin dry process.

The two feed robots 38, 40 serve to feed semiconductor wafers W. Each of the feed robots 38, 40 has a hand for holding a dry semiconductor wafer W and a hand for holding a wet semiconductor wafer W. If a robot (first robot) 56 in the loading/unloading section D is used to remove a semiconductor wafer W from the cleaning unit in the final stage, then the robot 40 may only have a hand for holding a wet semiconductor wafer W. The robot (second robot) 38 is not a mobile robot, but is fixed in a position near the rotary transporter 26. The robot 38 is rotatable to change its direction for transferring a semiconductor wafer W. The robot (third robot) 40 is a mobile robot movable along the array of cleaning units 32, 34 and 36.

Of the two reversing machines 42, 44, the reversing machine 42 serves to reverse a dry semiconductor wafer W and is movable between an end of the cleaning section B near the polishing section A and an opposite end of the cleaning section B near the loading/unloading section D. The second reversing machine 44 serves to reverse a wet semiconductor wafer W, and is housed in a cover 52.

The loading/unloading section D has an array of cassette bases 54 for placing thereon wafer cassettes C which house semiconductor wafers W or which are to house semiconductor wafers W, and a single robot (first robot) 56 for feeding a semiconductor wafer W. The robot 56 has a single hand for holding a dry semiconductor wafer W.

The polishing section A, the cleaning section B, and the loading/unloading section D are individually partitioned by walls so as to form respective chambers. The internal pressures of the chambers are controlled such that air in a chamber having a relatively low level of cleanliness does not leak into a chamber having a relatively high level of cleanliness. The walls have wafer passages defined therein. Each of the wafer passages has a vertically movable shutter, which is opened only when a semiconductor wafer W is to pass therethrough. When air is discharged from the polishing apparatus, the air is passed through a HEPA or ULPA filter so as to prevent the environment of a clean room in which the polishing apparatus is installed, from being contaminated by the discharged air.

Operation of the polishing apparatus shown in FIG. 1 will be described below. First, operation of the polishing section A will be described below. Since the polishing section A has the single rotary transporter 26 for replacing semiconductor wafers W on the plural top rings 16, it is most efficient to polish semiconductor W on three top rings 16 out of phase with each other. Depending on the material of semiconductor wafers W and the polishing process, however, it maybe possible to select an operation controls program to polish all semiconductor wafers W simultaneously in a batch process after the semiconductor wafers W have been mounted on all the top rings 16.

The former standard polishing process will be described below. A wafer cassette C which houses semiconductor wafers to be polished is automatically or manually supplied from the outside of the polishing apparatus to the loading/unloading section D, and placed on one of the cassette bases 54 in the loading/unloading section D.

The first robot 56 in the loading/unloading section D removes a semiconductor wafer W from the supplied wafer cassette C, and transfers the removed semiconductor wafer W to the reversing machine (first reversing machine) 42 in the cleaning section B. The firsts reversing machine 42 which has received the semiconductor wafer W reverses the semiconductor wafer W such that its surface to be polished faces downwardly, and then moves to a position confronting the second robot 38.

The second robot 38 rotates so as to face the first reversing machine 42, and receives the semiconductor wafer W from the first reversing machine 42 with the hand which serves to hold a dry semiconductor wafer. Then, the second robot 38 rotates so as to face the rotary transporter 26 in the polishing section A, and transfers the semiconductor wafer W to the pusher 24 of the rotary transporter 26 which is positioned closer to the cleaning section B, i.e., the pusher 24 closer to the second robot 38.

In the polishing section A, semiconductor wafers W on three top rings 16 are polished about 120° out of phase each other. Specifically, as shown in FIG. 1, a primary polishing of a semiconductor wafer W is carried out in a first polishing position which confronts the rotary transporter 26 on the polishing surface 10 of the polishing table 12 for a period of time that is about one-third of the total polishing time. Then, the top ring support assembly 18 is turned 120° to transfer the semiconductor wafer W to a second polishing section position that is 120° spaced downstream from the first polishing position with respect to the direction in which the polishing table 12 is rotated, and then a secondary polishing of the semiconductor wafer W is carried out in the second polishing position. Thereafter, the top ring support assembly 18 is further turned 120° to transfer the semiconductor wafer W to a third polishing position that is 120° spaced downstream from the second polishing position with respect to the direction in which the polishing table 12 is rotated, and then a tertiary polishing of the semiconductor wafer W is carried out in the third polishing position. Since the first polishing position is also a wafer transfer position, the period of time during which the semiconductor wafer W is polished in the first polishing position is shorter than the periods of time during which the semiconductor wafer W is polished in the second and third polishing positions. Simultaneously with the polishing of the semiconductor wafer W, the polishing surface 10 is dressed by the dresser 18.

The operation of the polishing section A will be described in greater detail below. When the polishing of the semiconductor wafer W in the third polishing position is finished, the top ring 16 which carries the polished semiconductor wafer W is lifted, and the top ring support assembly 18 is turned 120° to bring the top ring 16 to a wafer transfer position, i.e., the first polishing position. When the top ring support assembly 18 is turned, the dresser 28 is retracted out of the path of the top ring support assembly 18, as necessary. Then, the top ring 16 moves radially outwardly along the support arm 22 to a position above the pusher 24 located in the wafer transfer position near the polishing table 12. The top ring 16 is lowered by an air cylinder into abutment against the pusher 24 and transfers the polished semiconductor wafer W to the pusher 24. Then, the top ring 16 is lifted and waits in an upper standby position.

In the first embodiment, the attitude of the polishing table 12 is stably controlled by the magnetic bearings 80, 82, even when the top rings 16 are lifted off the polishing table 12 at the completion of the polishing operation, or landed on the polishing table 12 at the start of the polishing operation, or when the dresser 28 is lifted off or landed on the polishing table 12. Since the polishing table 12 is supported in a noncontact manner by the magnetic bearings (noncontact bearings) 80, 82, the polishing table 12 rotates smoothly and hence the semiconductor wafers W can be polished to a high degree of flatness. Furthermore, because the polishing table 12 is supported at its outer circumferential edge by the radial magnetic bearing 82, the load applied to the polishing table 12 is distributed, and hence the polishing table 12 is stably supported without undue deformations.

Depending on the polishing process, the semiconductor wafer holding surfaces of the top rings 16 from which semiconductor wafers W have been removed may be cleaned by a liquid such as pure water or a chemical solution ejected under a given pressure from a top ring cleaning nozzle (not shown). In addition, a cleaning liquid may be supplied to clean the liquid supply nozzle 14 depending on the polishing liquid or the polishing process. The feed robots 38, 40, the reversing machines 42, 44, and the rotary transporter 26 may have a self-cleaning mechanism for cleaning themselves with suitable timing depending on the polishing process.

After receiving the polished semiconductor wafer W from the top ring 16, the rotary transporter 26 is turned 180° to locate the pusher 24 that has received the polished semiconductor wafer W at the wafer transfer position near the cleaning section B and locate the pusher, 24 that carries a semiconductor wafer W to be polished at the wafer transfer position near the polishing table 12. The top ring 16 is lowered from the upper standby position, receives under vacuum the semiconductor wafer W to be polished from the pusher 24, and is then lifted. Thereafter, the top ring 16 holding the semiconductor wafer W to be polished moves radially inwardly along the support arm 22 toward the center of the top ring support assembly 18 until the top ring 16 is positioned over the polishing surface 10 of the polishing table 12. When the angular movement of the rotary transporter 26 finishes, the dresser 28 returns from the retracted position to an operative position, and dresses the polishing surface 10.

The top ring 16 is lowered by the air cylinder to press the surface to be polished of the semiconductor wafer W held by the top ring 16 against the polishing surface 10 under a predetermined pressure, and starts polishing the semiconductor wafer W. During this time and also while the top ring support assembly 18 is rotating, the other two top rings 16 are continuously polishing semiconductor wafers W that are carried by these top rings 16. In order to rotate the top ring support assembly 18 smoothly, the top ring support assembly 18 may be lifted to space all the semiconductor wafers W held by the top rings 16 away from the polishing surface 10.

Before the top ring 16 which holds an unpolished semiconductor wafer W or a semiconductor wafer W in the process of being polished is lowered to bring the surface to be polished of the semiconductor wafer W into contact with the polishing surface 10, the top ring 16 starts rotating. The polishing table 12 is rotated at all times during the polishing process. Therefore, the semiconductor wafer W is polished while the top ring 16 and the polishing table 12 are rotating. If the polishing surface 10 comprises a polishing cloth, then the polishing surface 10 is supplied with a polishing liquid (abrasive liquid) from the liquid supply nozzle 14 during the polishing process. If the polishing surface 10 comprises the abrading plate 11, then the polishing surface 10 is supplied with pure water from the liquid supply nozzle 14 during the polishing process.

After the polishing of a semiconductor wafer W is finished, the polished semiconductor wafer W is transferred from the top ring 16 to the rotary transporter 26, and an unpolished semiconductor wafer W is transferred from the rotary transporter 26 to the top ring 16. As the polishing of the semiconductor wafers W held by the three top rings 16 is finished, the polished semiconductor wafers W are successively transferred from the top rings 16 to the rotary transporter 26 and unpolished semiconductor wafers W are successively transferred from the rotary transporter 26 to the top rings 16. During this operation, the polished and unpolished semiconductor wafers W are transferred between the rotary transporter 26 and the second robot 38. Specifically, the second robot 38 successively removes the polished semiconductor wafers W from the rotary transporter 26, and successively delivers the unpolished semiconductor wafers W to the rotary transporter 26.

In the polishing process, the polishing surface 10 of the polishing table 12 is steadily dressed by the dresser 28. The polishing surface 10 is fully regenerated in the first polishing position, and the regenerated effect of the polishing surface 10 is reduced progressively in the second and third polishing positions. Therefore, when a plurality of semiconductor wafers W are to be simultaneously polished, the polishing positions depending on the remaining dressing effect on the polishing surface 10 may be selected to polish the semiconductor wafers W effectively.

In this embodiment, the polishing surface 10 comprises a fixed abrasive surface provided by the abrading plate 11 which causes self-generation of abrasive particles during the polishing process, and the abrasive particles are generated by dressing. If one of the top rings 16 places the semiconductor wafer W on a center; of the polishing table 12 for polishing the semiconductor wafer W, the surface of the polishing table 12 can effectively be utilized for an increased throughput. However, if the polishing table 12 comprises a turntable, then the center of the polishing table 12 has a weak polishing capability. In this embodiment, since the fixed abrasive surface of the polishing surfaced 10 has the self-stop ability effective to produce uniformly polished surfaces on the semiconductor wafer W, the weak polishing capability poses no problem. In the first polishing position, the polishing surface 10 polishes a semiconductor wafer W initially at a high polishing rate to remove large surface irregularities with the abundant abrasive particles available in the first polishing position. In the second polishing position, the polishing surface 10 polishes the semiconductor wafer W secondarily at a medium polishing rate. In the third polishing position, the polishing surface 10 conducts a finish polishing of the semiconductor wafer W.

In the illustrated embodiment, a semiconductor wafer W is successively moved in one direction to the three polishing positions and successively polished in the three polishing positions. However, the semiconductor wafer W may be moved in different patterns. For example, the semiconductor wafer W may be moved back from the third polishing position to the second polishing position. Alternatively, semiconductor wafers W of different types may be polished only in their respective polishing positions.

In the polishing apparatus, it may be desirable to remove the same amount of material from the semiconductor wafers in the respective polishing positions. This may be achieved by changing the polishing pressure applied by the top rings 16, and the rotational speed, i.e., the sliding speed, of the top rings 16. For example, the polishing pressure and/or the rotational speed of the top ring 16 is reduced in the first polishing position where the dressing effect remains large, and is increased in the second and third polishing positions where the dressing effect remains small, for thereby eliminating nonuniformity in the amount of material to be removed among the semiconductor wafers held by the top rings 16. As described above, the polishing pressure and/or the rotational speeds of the top rings 16 are adjusted in order to uniformize the polishing rates in the respective polishing positions. However, the polishing pressure and/or the rotational speeds of the top rings 16 may be adjusted to intentionally make the polishing rates in the respective polishing positions different.

The polished semiconductor wafer W removed from the rotary transporter 26 by he second robot 38 is delivered to a cleaning process in the cleaning section B. Specifically, the second robot 38 removes the polished semiconductor wafer W with its hand for holding a wet semiconductor wafer W, is turned 180°, and transfers the polished semiconductor wafer W to the second reversing machine 44 for reversing a wet semiconductor wafer W.

The polished semiconductor wafer W is cleaned in the cleaning B section as follows: The semiconductor wafer W transferred to the second reversing machine 44 by the second robot 38 is reversed to cause the polished surface to face upwardly. The reversed semiconductor wafer W is then removed laterally from the second reversing machine 44 by the third robot 40 that is movable. The third robot 40 which has received the semiconductor wafer W moves to the position confronting the first cleaning unit 32, and transfers the semiconductor wafer W to the first cleaning unit 32. The third robot 40 uses its hand for holding a wet semiconductor wafer W to transfer the semiconductor wafer W to the first cleaning unit 32. In the first cleaning unit 32, the rollers 46 hold t circumferential edge of the semiconductor wafer W and rotate he semiconductor wafer W at a relatively low speed, and the sponge rolls 48 clean both surfaces of the semiconductor wafer W while the semiconductor wafer W is rotating at the relatively low speed.

After the semiconductor wafer W is cleaned in the first cleaning unit 32, the third robot 40 removes the cleaned semiconductor wafer W from the first cleaning unit 32, carries the cleaned semiconductor wafer W to the second cleaning unit 34, and transfers the cleaned semiconductor wafer W to the second cleaning unit 34. In the second cleaning unit 34, the holder 50 holds the semiconductor wafer W, and a jet of cleaning liquid is applied to both surfaces or the polished surface of the semiconductor wafer W to clean the semiconductor wafer W while the holder 50 is rotating at a relatively high speed.

After the semiconductor wafer W is cleaned in the second cleaning unit 341, the third robot 40 removes the cleaned semiconductor wafer W from the second cleaning unit 34, carries the cleaned semiconductor wafer W to the third cleaning unit 36, and transfers the cleaned semiconductor wafer W to the third cleaning unit 36. The third robot 40 uses its hand for holding a wet semiconductor wafer W to transfer the semiconductor wafer W to the third cleaning unit 36. In the third cleaning unit 36, the holder 50 holds the semiconductor wafer W, and the polished surface of the semiconductor wafer W is cleaned with a pencil-shaped sponge member while the holder 50 is rotating at a relatively high speed, after which the semiconductor wafer W is rotated at a high speed to dry the semiconductor wafer W by way of a spin dry process.

After the semiconductor wafer W is cleaned and dried in the cleaning section B, the semiconductor wafer W is removed from the third cleaning unit 36 by the third robot 40 and then returned to the wafer cassette C from which the semiconductor wafer W was supplied, by the first robot 56 in the loading/unloading section D. Therefore, semiconductor wafers W are processed by a dry-in and dry-out process in the polishing apparatus, and then delivered to a next process in the clean room.

Figure 4:
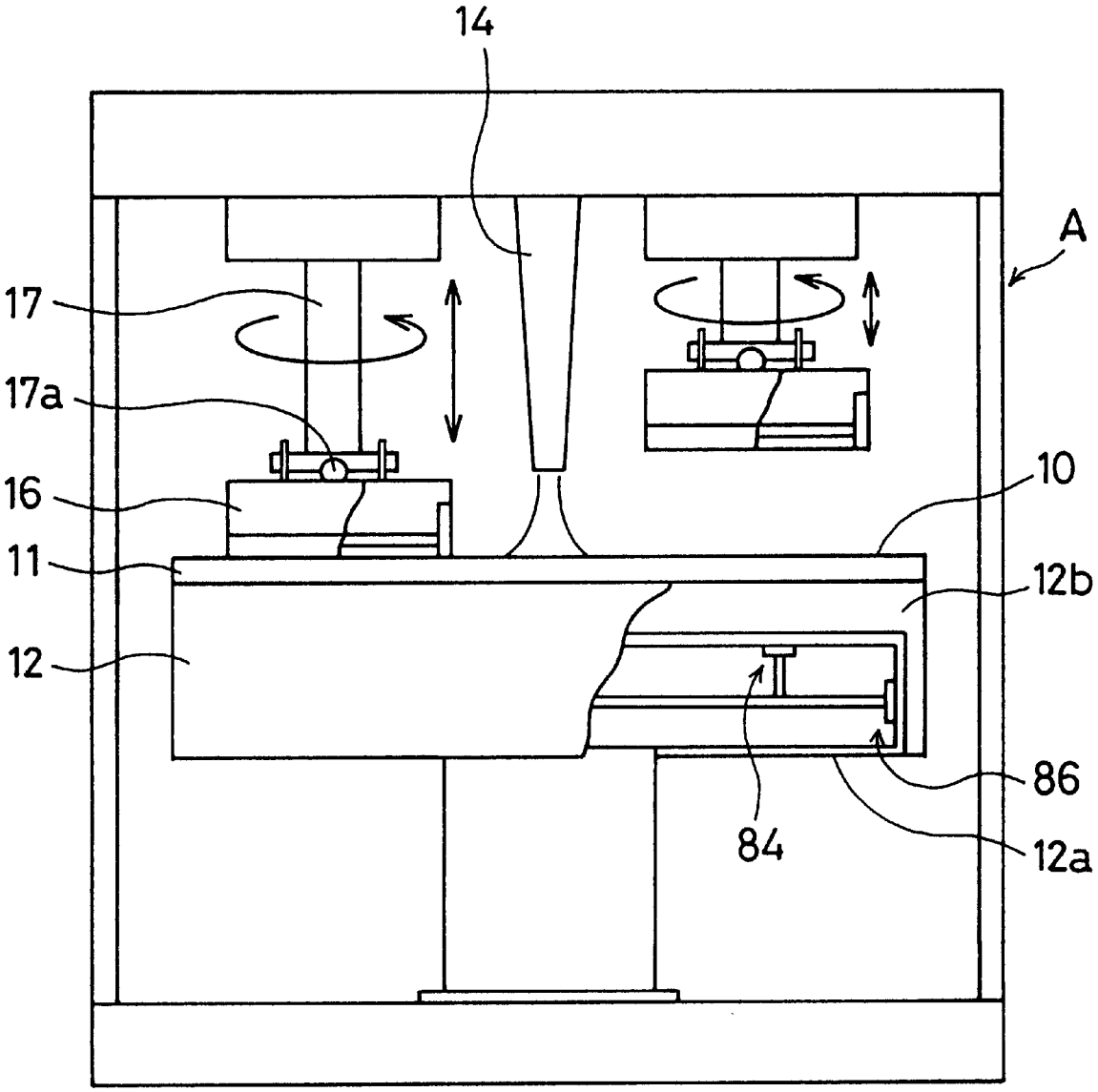
FIG. 4 is a partly broken front view showing a modification of the polishing apparatus shown in FIG. 1.

FIG. 4 shows a modification of the polishing apparatus shown in FIG. 2. In FIG. 4, the polishing table 12 is supported in a noncontact manner by hydrostatic bearings 84, 86 which employ a fluid pressure such as of a pressurized gas or the like. The hydrostatic bearings 84, 86 are of a simpler structure which is capable of controlling the attitude of the polishing table 12 depending on the load on the polishing table 12.

Figure 5:
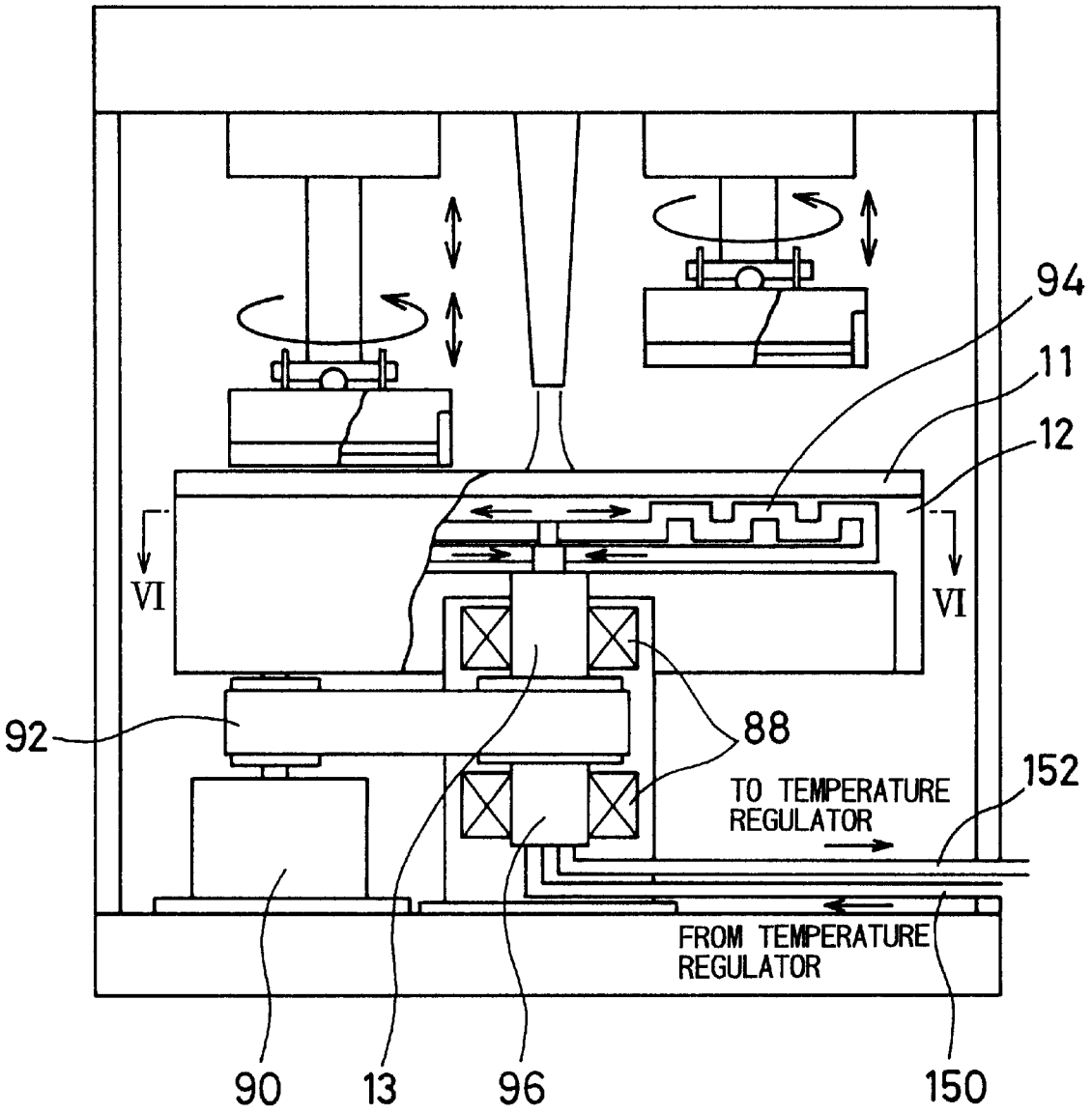
FIG. 5 is a partly broken front view showing another modification of the polishing apparatus shown in FIG. 1.
Figure 6A:
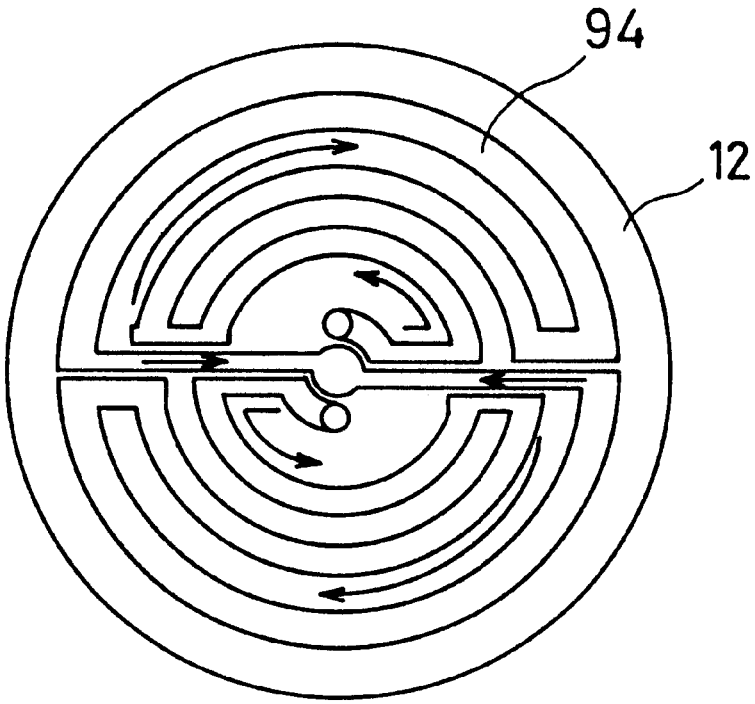
FIGS. 6A and 6B are cross-sectional views taken along line VI—VI of FIG. 5, showing different heating medium path patterns.
Figure 6B:
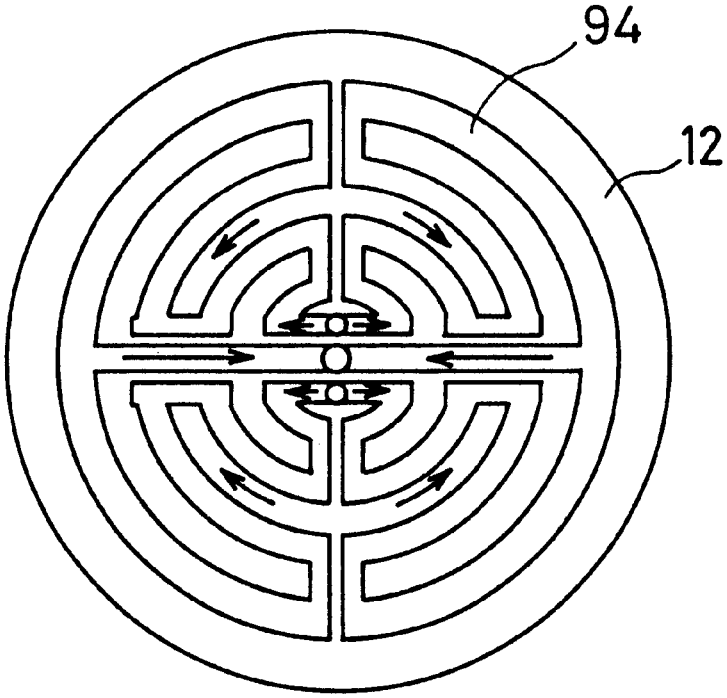

FIGS. 5 and 6A, 6B show another modification of the polishing apparatus shown FIG. 2. In FIG. 5, the polishing table 12 is mounted on a support post 13 that is supported by upper and lower bearings 88. The polishing table 12 is rotated by a drive motor 90 whose torque is transmitted via a belt and pulley mechanism 92 to the support port 13.

According to the modification shown in FIGS. 5 and 6A, 6B, the polishing table 12 has a temperature regulating path 94 defined therein for passing a temperature regulating heating medium therethrough. FIGS. 6A and 6B show different path patterns for the temperature regulating path 94. As shown in FIGS. 6A and 6B, the temperature regulating path 94 is formed so as to cover the entire surface of the polishing table 12, and communicates with fluid paths formed through the support post 13. The fluid paths are connected to inlet and outlet pipes 150, 152 for supplying a heating medium via a fluid coupling 96. The heating medium is supplied to the temperature regulating path 94 to regulate the temperature of the polishing table 12 for preventing the polishing table 12 from being deformed and for keeping the polishing surface 10 at a constant temperature to minimize variations in the polishing rate of the chemical mechanical polishing process.

Figure 7:
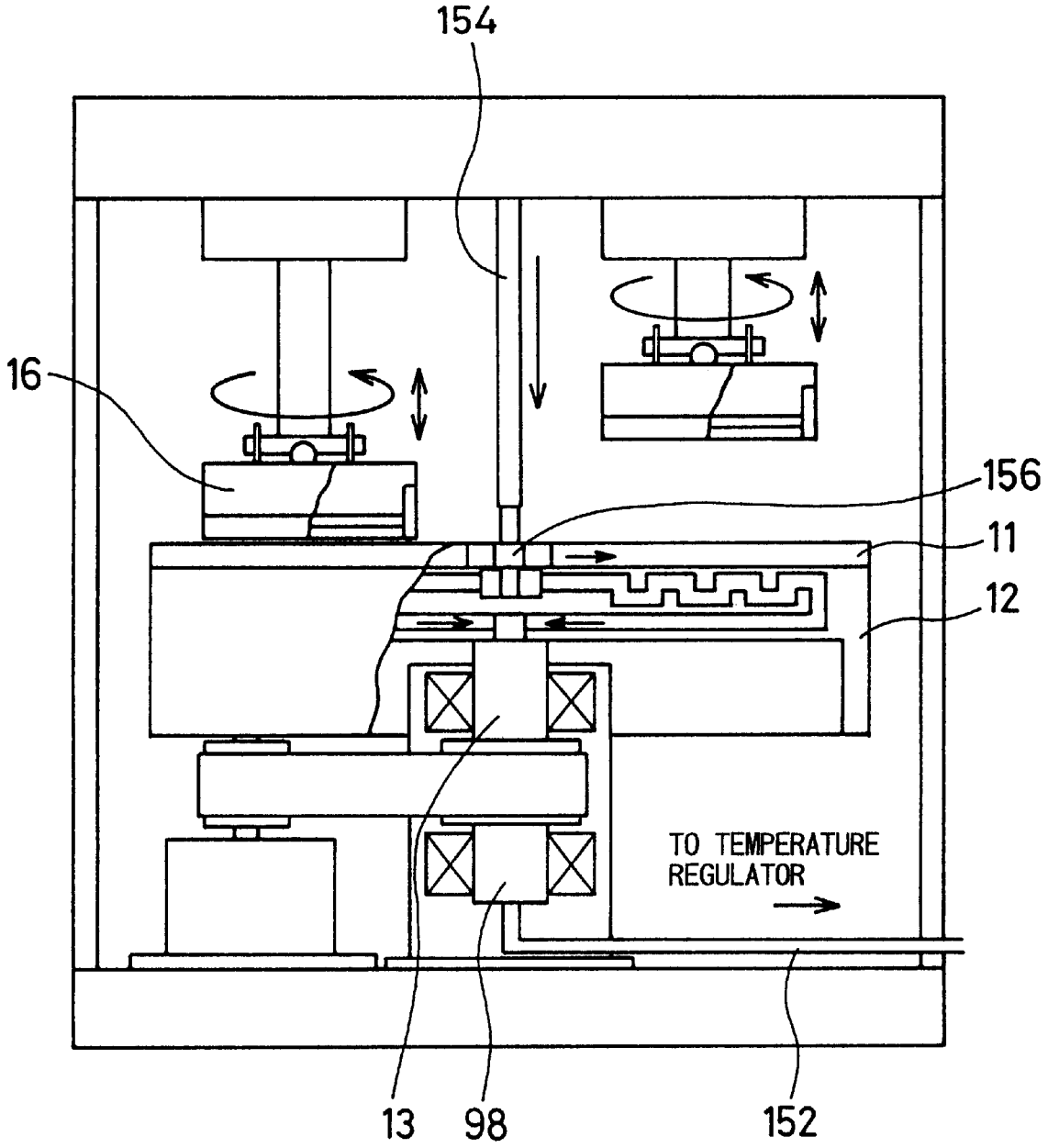
FIG. 7 is a partly broken front view showing a modification of the polishing apparatus shown in FIG. 5.

FIG. 7 shows a modification of the polishing apparatus shown in FIG. 5. In FIG. 7, one of the pipes which is connected to the temperature regulating path 94, i.e., the inlet pipe 154 in FIG. 7, extends downwardly and is connected to a fluid coupling 156 disposed centrally in the polishing table 12. Since the inlet pipe 154 is not formed in the support post 13, the fluid path in the support post 13 and the fluid coupling are not complex in structure.

Figure 8:
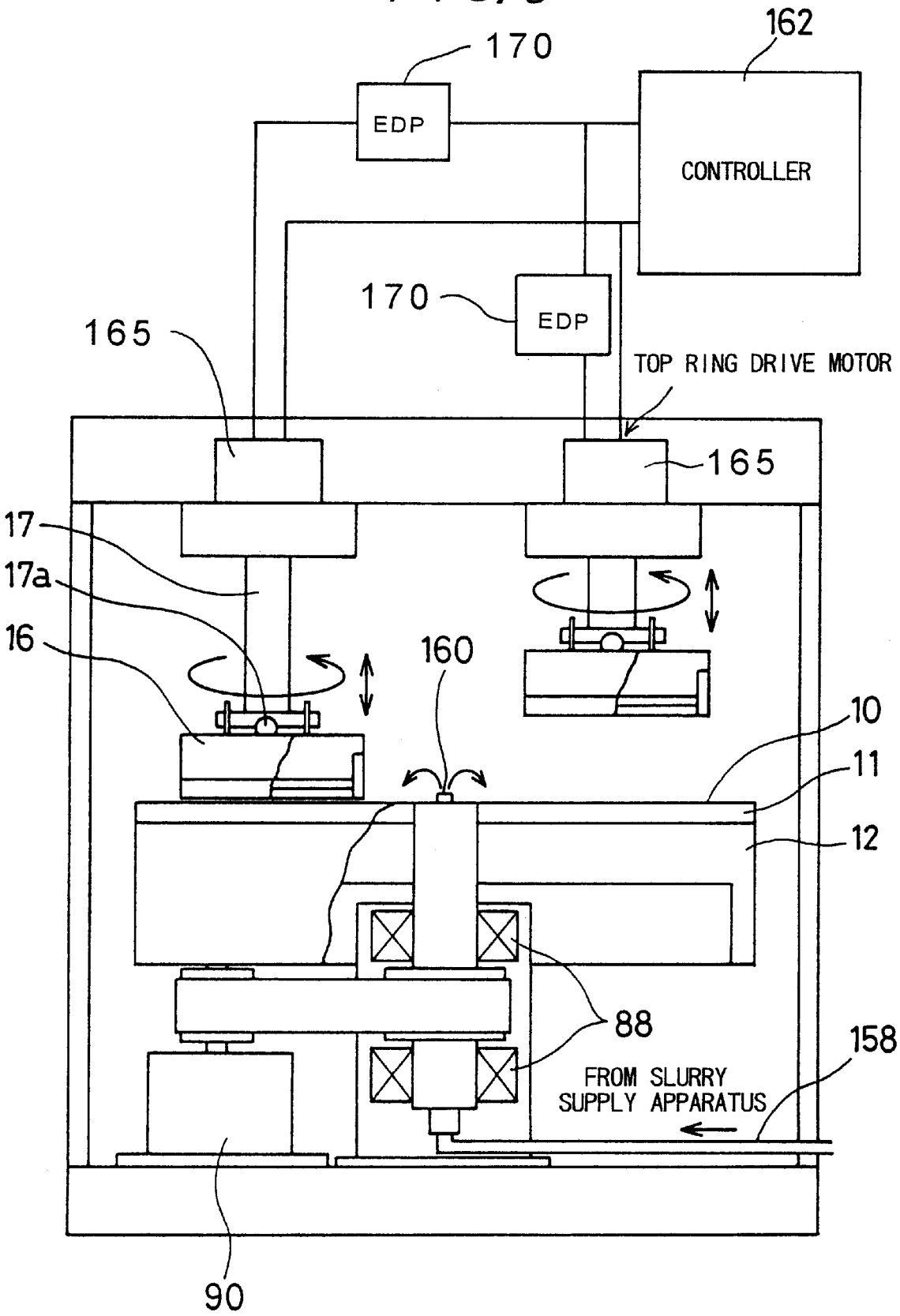
FIG. 8 is a partly broken front view showing another modification of the polishing apparatus shown in FIG. 5.

FIG. 8 shows another modification of the polishing apparatus shown in FIG. 5. In FIG. 8, a polishing liquid is supplied from an inlet pipe 158 to a fluid path formed through the support post 13. A liquid supply nozzle 160 is mounted on the upper end of the fluid path in the support post 13 and opens at the polishing surface 10. Accordingly, an unpolishing surface is formed inwardly of the polishing surface 10 by the liquid supply nozzle 160. If the polishing table 12 comprises a turntable, then since the unpolishing surface has a weak polishing capability, it may effectively be used to install a structure for supplying and discharging a polishing liquid or a temperature regulating heating medium, for example. Specifically, inasmuch as the polishing liquid is supplied from the fluid path in the support post 13, no liquid supply nozzle needs to be positioned above the polishing table 12, and thus does not interfere with the top rings 16 and the top ring support assembly, thereby allowing semiconductor wafers W to be changed smoothly.

The modified polishing apparatus shown in FIG. 8 has a sensor (not shown) for detecting the torque of a drive motor 165 for rotating each of the top rings 16, and a controller 162 for controlling the rotation and pressure of each of the top rings 16 based on the detected torque. The controller 162 shown in FIG. 8 controls the rotational speeds of the motors 165 independently of each other as in the case of the controller described above which is not shown in FIG. 2. Thus, the top rings 16 are controlled individually to operate their polishing independently of each other. Further, each of the motors 165 for rotating the top ring 16 is connected to an endpoint detector (EDP) 170 for detecting an endpoint of polishing of the semiconductor wafer W by detecting a torque of the motor 165, or vibration of the motor 165, or the like. The endpoint detector 170 is connected to the controller 162. When the endpoint of polishing of the semiconductor wafer W held by the top ring 16 is detected by the endpoint detector 170, such top ring 16 is independently controlled so as to finish the polishing of the semiconductor wafer.

Figure 9:
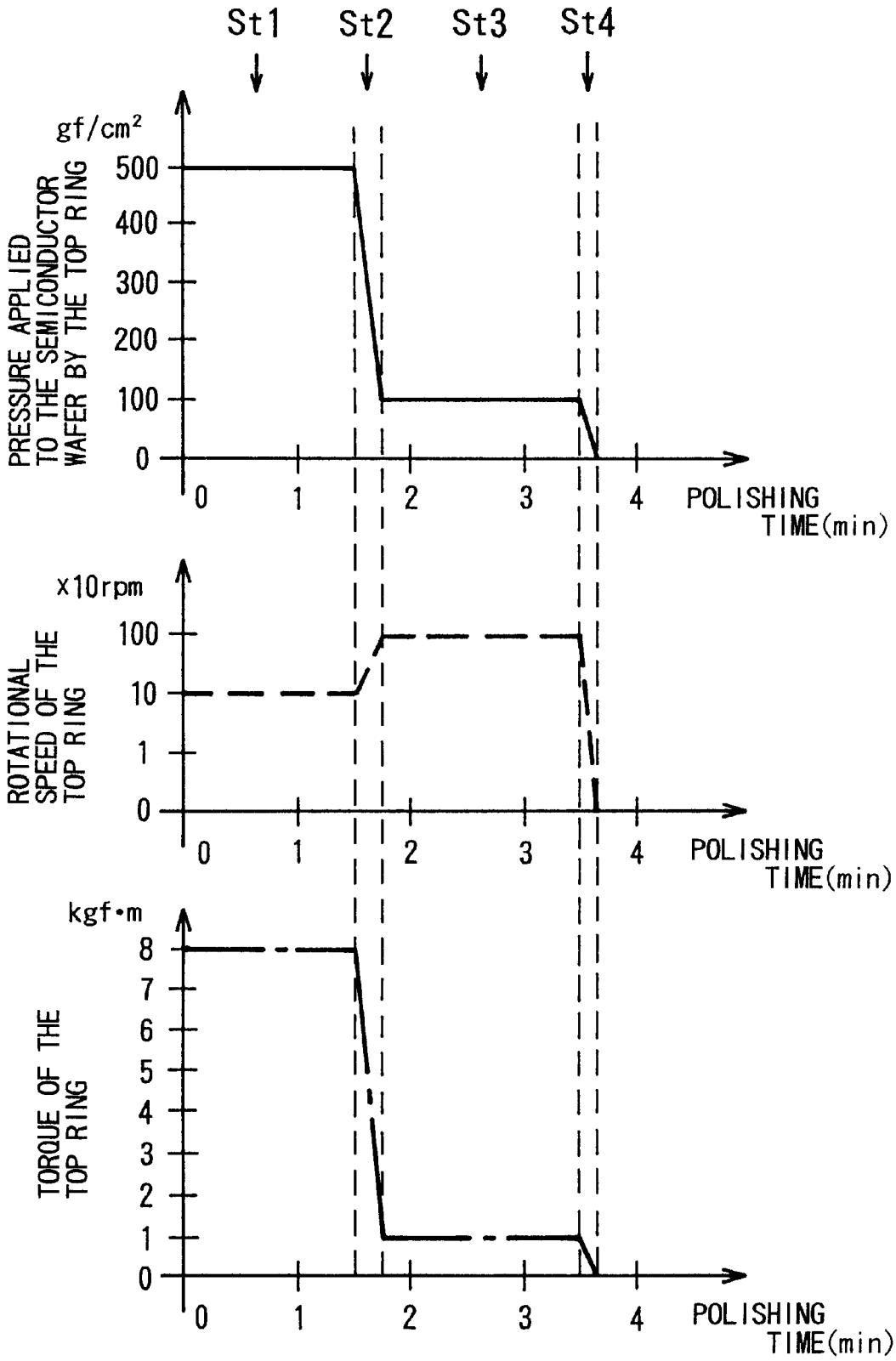
FIG. 9 is a graph illustrative of a control process performed by a controller of the polishing apparatus shown in FIG. 8.

FIG. 9 illustrates a control process performed by the controller 162 of the polishing apparatus shown in FIG. 8. In FIG. 9, the horizontal axis represents a polishing time (minute), and the vertical axis represents the pressure applied to the semiconductor wafer by the top ring, or the rotational speed of the top ring, or the torque of the top ring. According to the control process shown in FIG. 9, based on the fixed abrasive polishing principles that the polishing torque is reduced once the polished surface is planarized to a certain level, the endpoint of a polishing process on a semiconductor wafer W is detected and/or a certain type finish polishing of the semiconductor wafer W is performed. Specifically, in step 1, the pressure of the top ring 16 is set to 4.9 Pa (500 gf/cm$^2$) and the rotational speed of the top ring 16 is set to 100 rpm, and the semiconductor wafer W is polished in a normal polishing mode. As far as surface irregularities that remain on the semiconductor wafer W held by the top ring 16, the semiconductor wafer W is continuously polished, and the drive motor for the top ring 16 maintains a predetermined torque.

When the polished surface of the semiconductor wafer W reaches a predetermined level of flatness, the frictional force applied between the semiconductor wafer W and the top ring 16 decreases, resulting in a reduction in the detected torque of the drive motor. In step 2, the controller 162 lowers the pressure of the top ring 16 to about 0.98 Pa (100 gf/cm$^2$), and increases the rotational speed of the top ring 16 to about 1000 rpm. In step 3, the semiconductor wafer W is polished in a finish polishing mode under the lowered pressure and at the increased rotational speed. In step 4, the controller 162 lowers the pressure and rotational speed of the top ring 16, and finishes the polishing process. According to the above control process, the polishing apparatus can polish the semiconductor wafer W in the normal and finish polishing modes with periods of respective modes managed.

In the finish polishing mode, a film of polishing liquid is formed between the polishing surface 10 of the abrading plate 11 and the polished surface of the semiconductor wafer W which are held in sliding contact with each other, producing a hydroplaning phenomenon characterized by small frictional force and dynamic stability. While such a hydroplaning phenomenon has heretofore been recognized as being harmful for lowering the polishing efficiency, the polishing apparatus according to the present invention positively utilizes the hydroplaning phenomenon to polish semiconductor wafers W in the finish polishing mode.

Figure 10A:
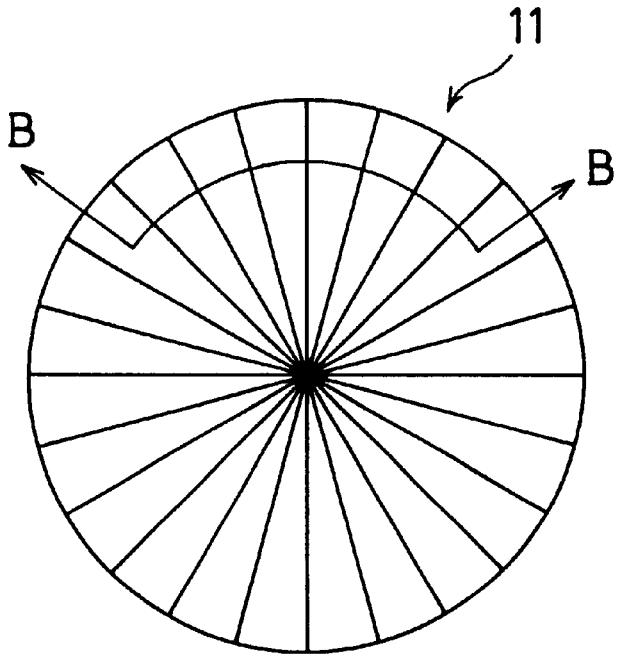
FIG. 10A is a plan view of an abrading plate which provides a polishing surfacer of the polishing apparatus shown in FIG. 8.
Figure 10B:
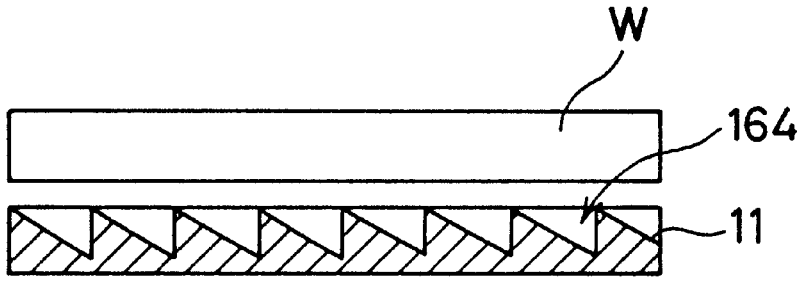
FIG. 10B is a cross-sectional view taken along line B—B of FIG. 10A.
Figure 10C:
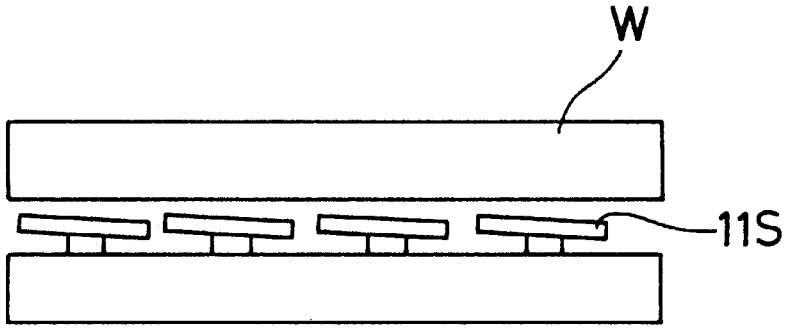
FIG. 10C is a cross-sectional view of an abrading plate according to another embodiment of the present invention.

FIGS. 10A through 10C show different abrading plates 11 that are provided with surface irregularities for allowing the hydroplaning phenomenon to be developed with ease. In FIG. 10A, the abrading plate 11 has a plurality of radial surface sectors each having a slanted surface such that the radial surface sectors provide a sawtooth-shaped cross-sectional shape in the circumferential direction, as shown in FIG. 10B. The abrading plate 11 shown in FIG. 10A may comprise a plurality of separate sectorial abrading plate segments 11s mounted on a base. In FIG. 10C, flat abrading plate segments are mounted as tilting pads on a base so that upper surfaces of the abrading plate segments are inclined with respect to the base.

Figure 11:
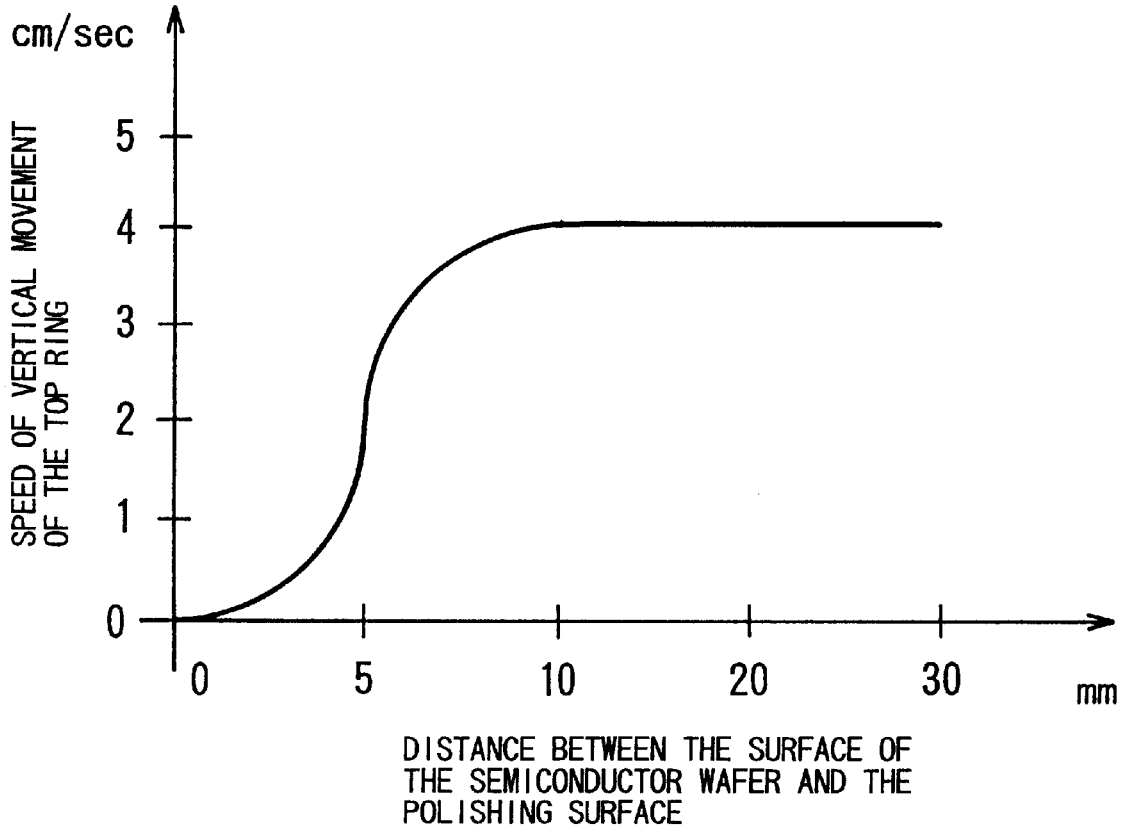
FIG. 11 is a graph illustrative of another control process for the polishing apparatus shown in FIG. 8.

FIG. 11 illustrates another control process for the polishing apparatus shown in FIG. 8. In FIG. 11, the horizontal axis represents the distance between the surface of the semiconductor wafer and the polishing surface 10, and the vertical axis represents the speed of vertical movement of the top ring 16. According to the control process shown in FIG. 11, the speed of vertical movement of the top ring 16 is controlled depending on the distance between the surface of the semiconductor wafer W and the polishing surface 10 of the abrading plate 11, as detected by a remote sensor mounted on the top ring support assembly, for example. Specifically, when the distance between the surface of the semiconductor wafer W and the polishing surface 10 is small, the speed of vertical movement of the top ring 16 is reduced. After (or until) the surface of the semiconductor wafer W and the polishing surface 10 are spaced from each other by a predetermined distance (about 8 mm in FIG. 11), the speed of vertical movement of the top ring 16 is kept at a constant level. This control process is effective to dampen shocks applied to the semiconductor wafer W and the polishing surface 10 when they move away from each other or contact each other, so that the semiconductor wafer can be polished stably.

Figure 12:
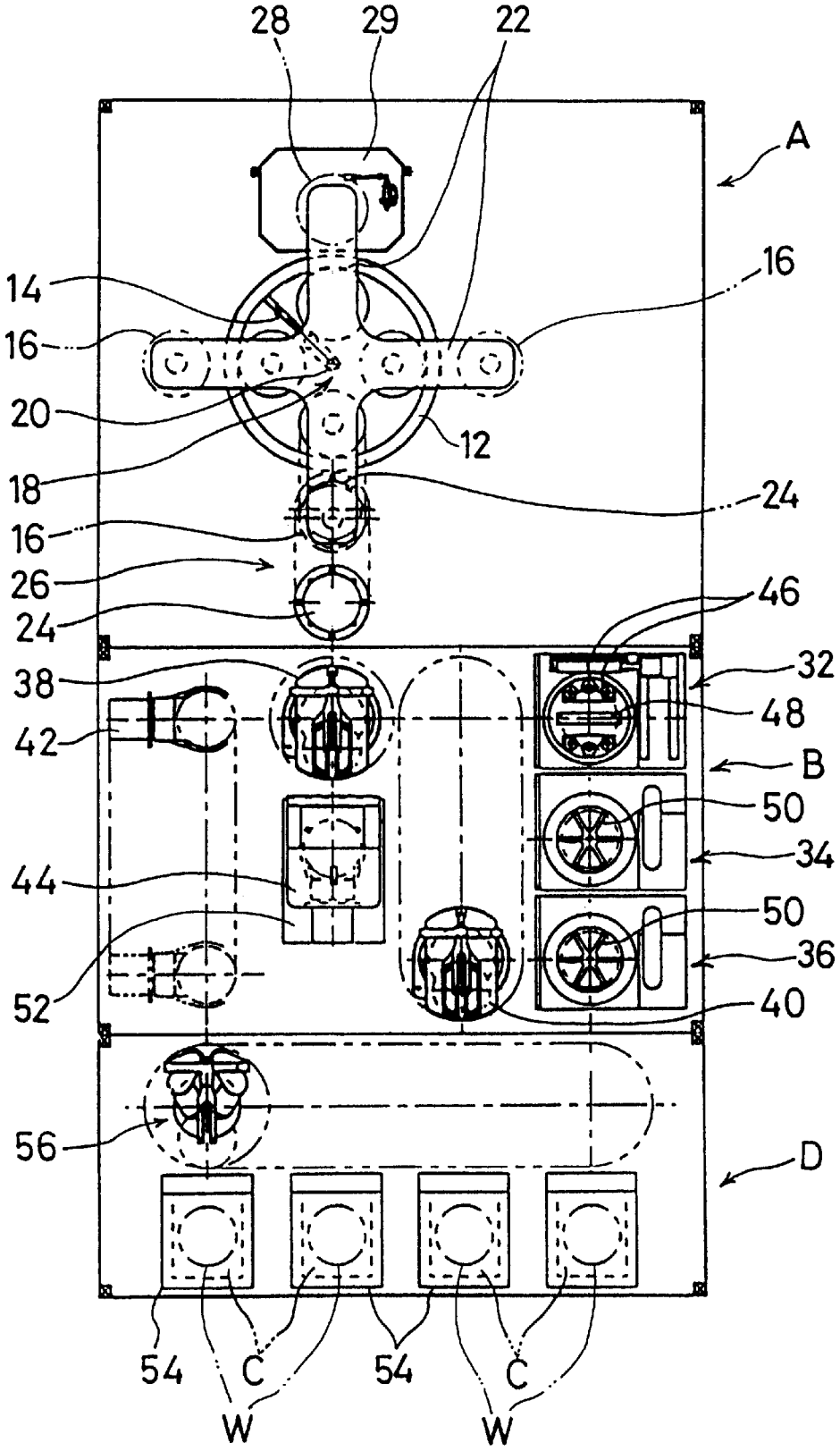
FIG. 12 is a plan view showing a polishing apparatus according to a second embodiment of the present invention.

FIG. 12 shows a polishing apparatus according to a second embodiment of the presents invention. The polishing apparatus according to the second embodiment has a cleaning section B and a loading/unloading section D which are identical to those of the polishing apparatus according to the first embodiment, and a polishing section A which differs from that of the polishing apparatus according to the first embodiment.

The polishing, apparatus has a top ring support body 18 having four support arms 22 for supporting three top rings 16 and a dresser 28. The top rings 16 and the dresser 28 are radially movable along the support arms 22 which support them. A cleaning container 29 which stores a cleaning liquid for cleaning the dresser 28 is disposed in a standby position opposite to the rotary transporter 26 with respect to the polishing table 12. Details of the polishing table 12 in the polishing section A are the same as those of any of the polishing tables 12 shown in FIGS. 2 through 11.

The polishing apparatus according to the second embodiment operates in essentially the same manner as the polishing apparatus according to the first embodiment. Since no separate support mechanism for the dresser 28 is required, the cost of the polishing apparatus is reduced. When the polishing of the semiconductor wafer finishes by one of the top rings 16, the top ring support assembly 18 is turned, the top ring 16 which carries the polished semiconductor wafer W is moved to the wafer transfer position where the polished semiconductor wafer W is replaced with an unpolished semiconductor wafer W. Unlike the polishing apparatus according to the first embodiment, the polishing surface can be dressed by the dresser 28 while the top ring support assembly 18 is being turned.

Figure 13:
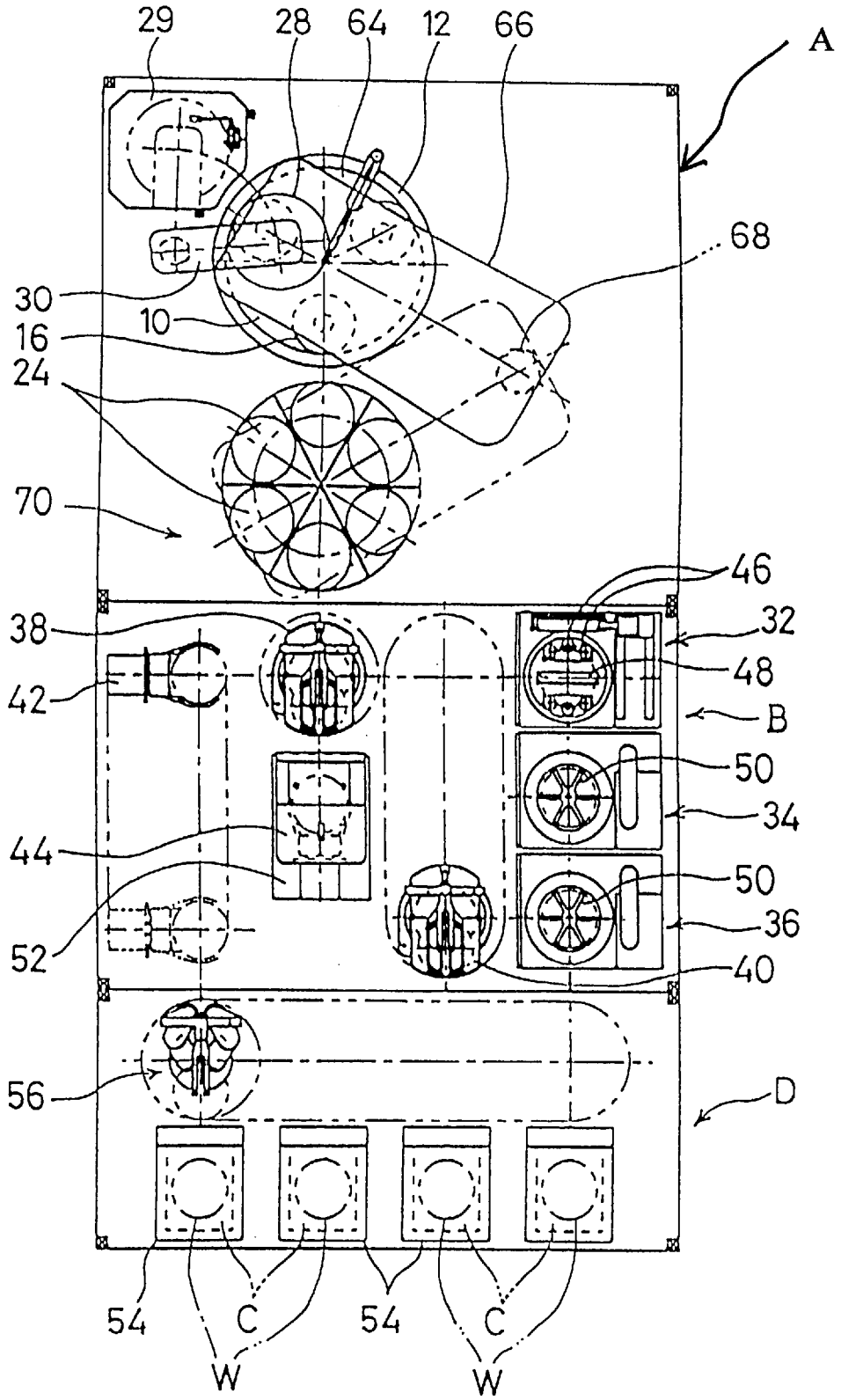
FIG. 13 is a plan view showing a polishing apparatus according to a third embodiment of the present invention.

FIG. 13 shows a polishing apparatus according to a third embodiment of the present invention. The polishing apparatus according to the third embodiment has a cleaning section B and a loading/unloading section D which are identical to those of the polishing apparatus according to the first embodiment, and a polishing section A which differs from that of the polishing apparatus according to the first embodiment.

As shown in FIG. 13, the polishing section A has three top rings 16 which are mounted on a support member 64. The support member 64 is rotatable in a horizontal plane about its own axis, and the top rings 16 are disposed: around the axis of the support member 64. The support member 64 is mounted on a distal end of a swing head 66 that is rotatable in a horizontal plane. The swing head 66 is supported at its proximal end by a support post 68. The support member 64 has motors and air cylinders for individually rotating the top rings 16 and moving the top rings 16 vertically.

A dresser 28 supported by a dresser arm 30 is disposed near the polishing table 12 for angular movement between a dressing position on the polishing surface 10 and a standby position outside of the polishing table 12. A cleaning container 29 which stores a cleaning liquid for cleaning the dresser 28 is disposed in the standby position.

The polishing section A also has a rotary transporter 70 having six pushers 24 which alternately hold unpolished semiconductor wafers W and polished semiconductor wafers W. When the swing head 66 is turned about the support post 68, each of the top rings 16 can move to a position over the rotary transporter 70 for attachment of a semiconductor wafer W to and removal of a semiconductor wafer W from the top ring 16. Details of the polishing table 12 in the polishing section A are the same as those of any of the polishing tables 12 shown in FIGS. 2 through 11.

In this embodiment, unpolished semiconductor wafers W are simultaneously installed on the three top rings 16 and also simultaneously polished in a batch process. Specific operation of the polishing apparatus according to the third embodiment will be described below. The process of carrying an unpolished semiconductor wafer W with the second robot 38 to the polishing section A is identical to the corresponding process carried out by the polishing apparatus according to the first embodiment.

The second robot 38 that has received the semiconductor wafer W from the first reversing machine 42 with the hand for holding a dry semiconductor wafer W is turned so as to face the rotary transporter 70, and transfers the semiconductor wafer W to a first loading pusher 24 on the rotary transporter 70. Each time the rotary transporter 70 receives a semiconductor wafer W, the rotary transporter 70 is turned 120° clockwise. The above process is repeated twice. Therefore, unpolished semiconductor wafers W are placed respectively on three loading pushers (first, second, and third loading pushers) 24 on the rotary transporter 70.

Then, the swing head 66 is turned to place the three top rings 16 over the rotary transporter 70. The rotary transporter 70 is turned 60° clockwise to position the three loading pushers 24 thereon in alignment with the three top rings 16, respectively. The air cylinders for vertically moving the top rings 16 are actuated to lower the top rings 16, and then the top rings 16 hold under vacuum the unpolished semiconductor wafers W on the three loading pushers 24. While the replacement of the semiconductor wafers W is carried out, the dresser arm 30 is turned to bring the dresser 28 over the polishing table 12 and the dresser 28 dresses the polishing surface 10 of the polishing table 12.

After the dresser 28 is retracted to the standby position, the top rings 16 that have received the semiconductor wafers W are lifted, and the swing head 66 is turned to bring the top rings 16 over the polishing surface of the polishing table 12. The top rings 16 and the dresser 28 are lowered, and the semiconductor wafers W supported by the top rings 16 are polished by the polishing surface 10 of the polishing table 12, while the polishing surface 110 is dressed by the dresser 28.

While the semiconductor wafers W are being polished, the semiconductor wafers W that have been polished and placed on the unloading pushers 24 on the rotary transporter 70 are discharged by the second robot 38, and semiconductor wafers to be polished next are supplied to the loading pushers 24 on the rotary transporter 70 according to the process described above.

When the polishing of the semiconductor wafers W is completed, the top rings 16 are elevated, and the swing head 66 is turned to position the top rings 16 over the rotary transporter 70 where the three unloading pushers 24 are positioned in alignment with the respective top rings 16. The top rings 16 are lowered into abutment against the unloading pushers 24, and transfer the polished semiconductor wafers W to the unloading pushers 24.

After transferring the polished semiconductor wafers W to the unloading pushers 24, the top rings 16 are lifted to a predetermined position, after which the support member 64 is turned 60° clockwise to position the top rings 16 over the loading pushers 24 on the rotary transporter 70. The top rings 16 are lowered to receive unpolished semiconductor wafers W from the loading pushers 241. Thereafter, the top rings 16 are lifted, and the swing head 66 is turned to position the top rings 16 over the polishing surface 10, after which the top rings 16 are lowered to polish the semiconductor wafers W.

The polished semiconductor wafers W that have been held by the unloading pushers 24 are successively removed from the unloading pushers 24 by the second robot 38, and transferred to the cleaning process in the cleaning section B. At this time, the second robot 38 delivers the polished semiconductor wafers W one by one. Specifically, the second robot 38 receives a polished semiconductor wafer W from a corresponding unloading pusher 24 with its hand for holding a wet semiconductor wafer W, is turned 180°, and transfers the received polished semiconductor wafer W to the second reversing machine 44.

During this time, the rotary transporter 70 is turned 120° clockwise to orient an unloading pusher 24 which is still holding a polished semiconductor wafer W toward the second robot 38. The second robot 38 which has transferred the semiconductor wafer W to the second reversing machine 44 is turned 180° to face the rotary transporter 70 again, receives the next polished semiconductor wafer W, and transfers the received semiconductor wafer W to the second reversing machine 44. The same process is repeated once more to deliver three semiconductor wafers W that have been simultaneously polished in one polishing process, successively to the cleaning section B. The process of cleaning the polished semiconductor wafers W in the cleaning section B and the subsequent processes are identical to the corresponding processes performed by the polishing apparatus according to the first embodiment.

Figure 14:
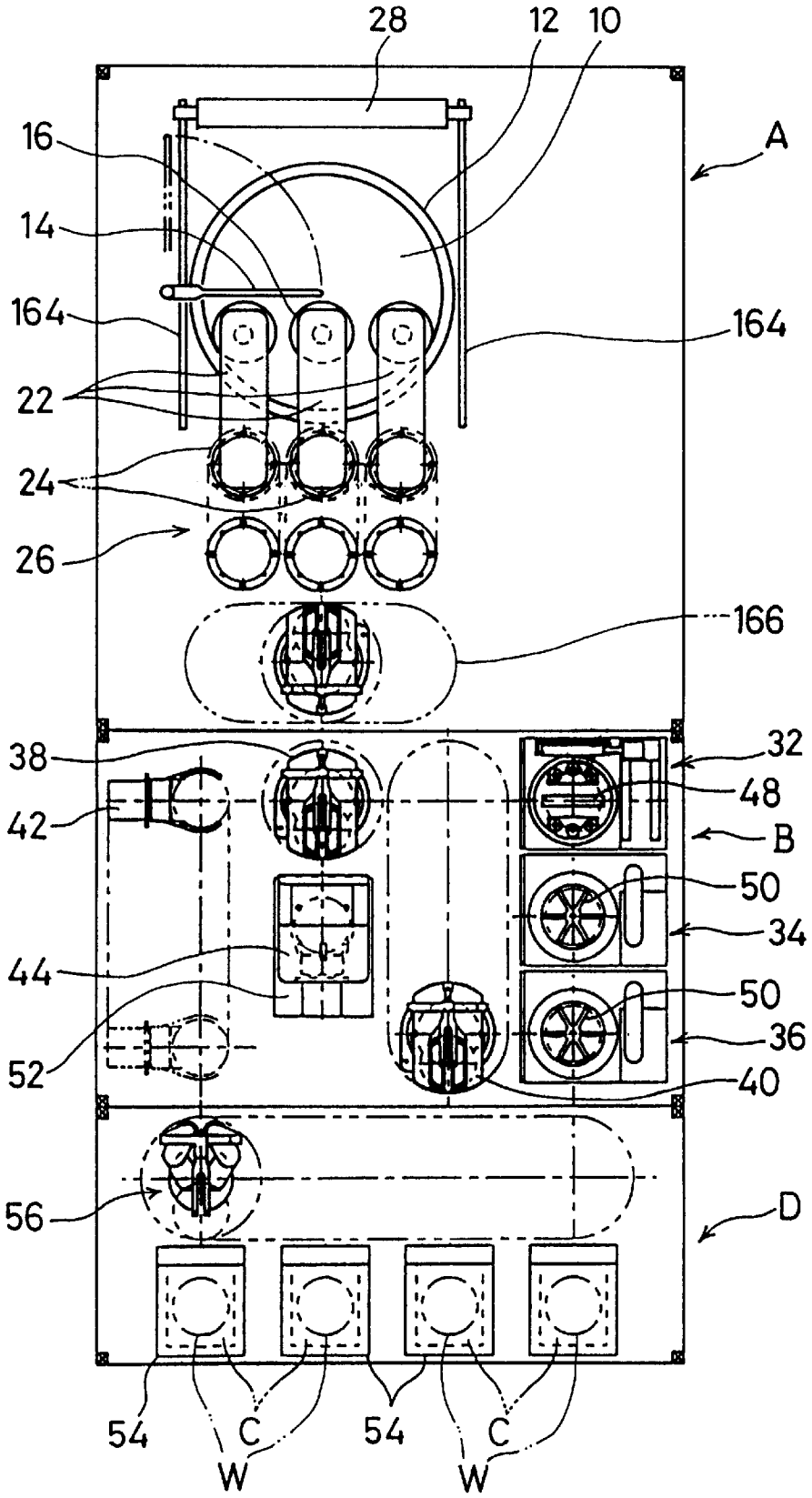
FIG. 14 is a plan view showing a polishing apparatus according to a fourth embodiment of the present invention.
Figure 15:
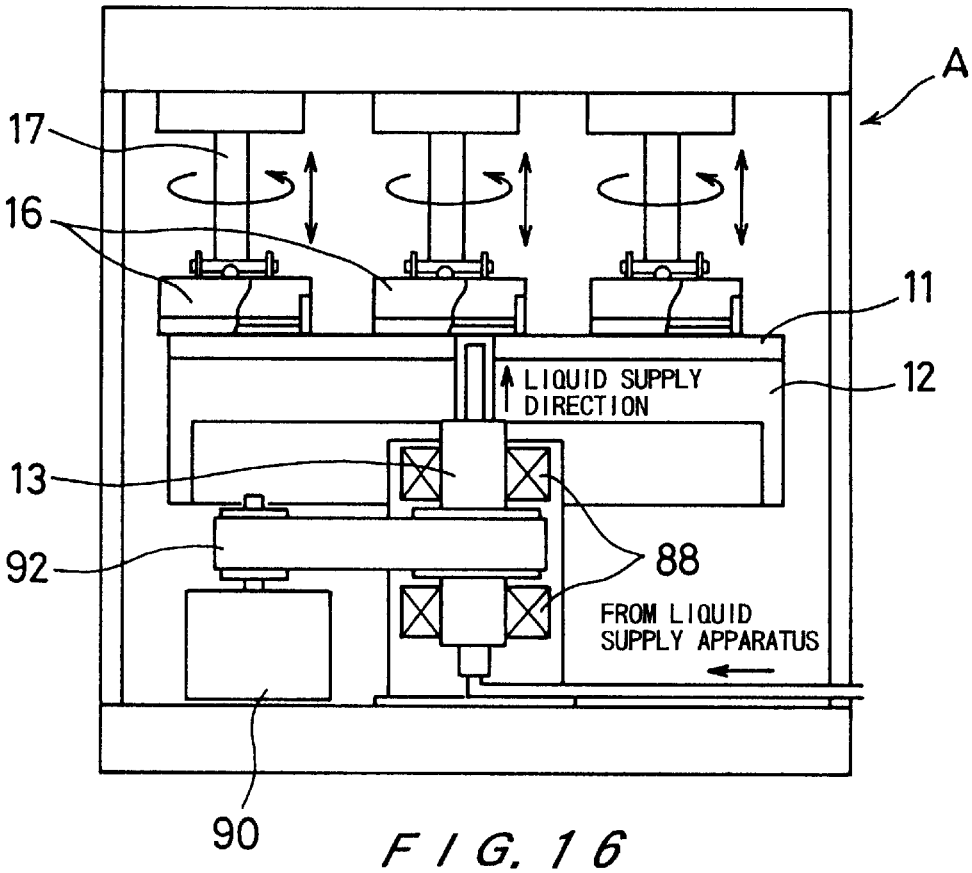
FIG. 15 is a partly broken front view showing the polishing apparatus shown in FIG. 14.
Figure 16:
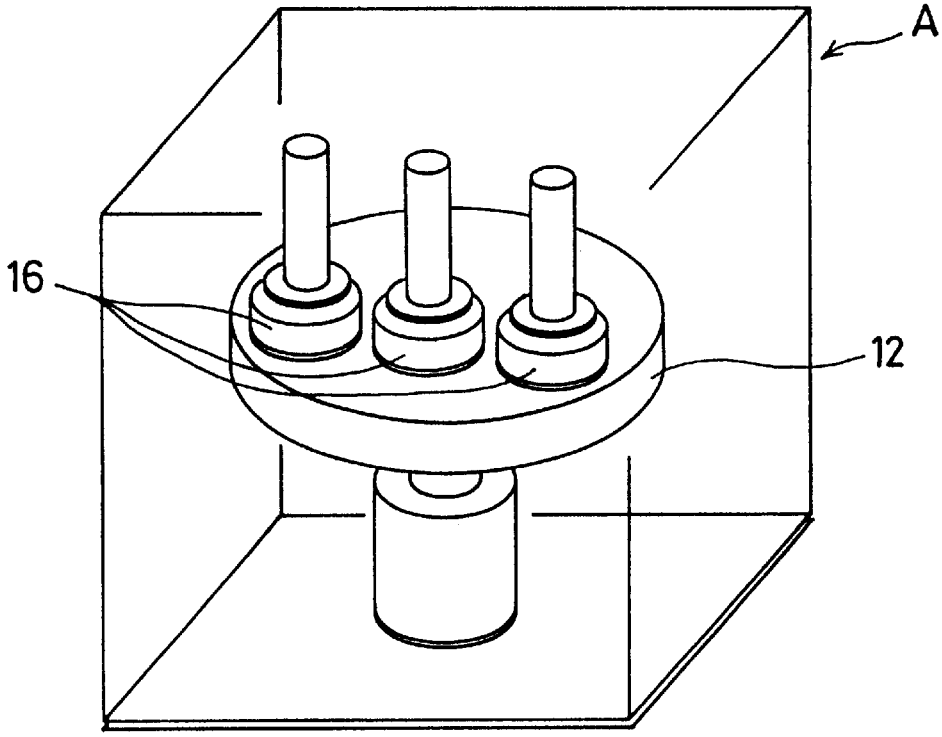
FIG. 16 is a schematic perspective view showing the polishing apparatus shown in FIG. 14.
Figure 17:
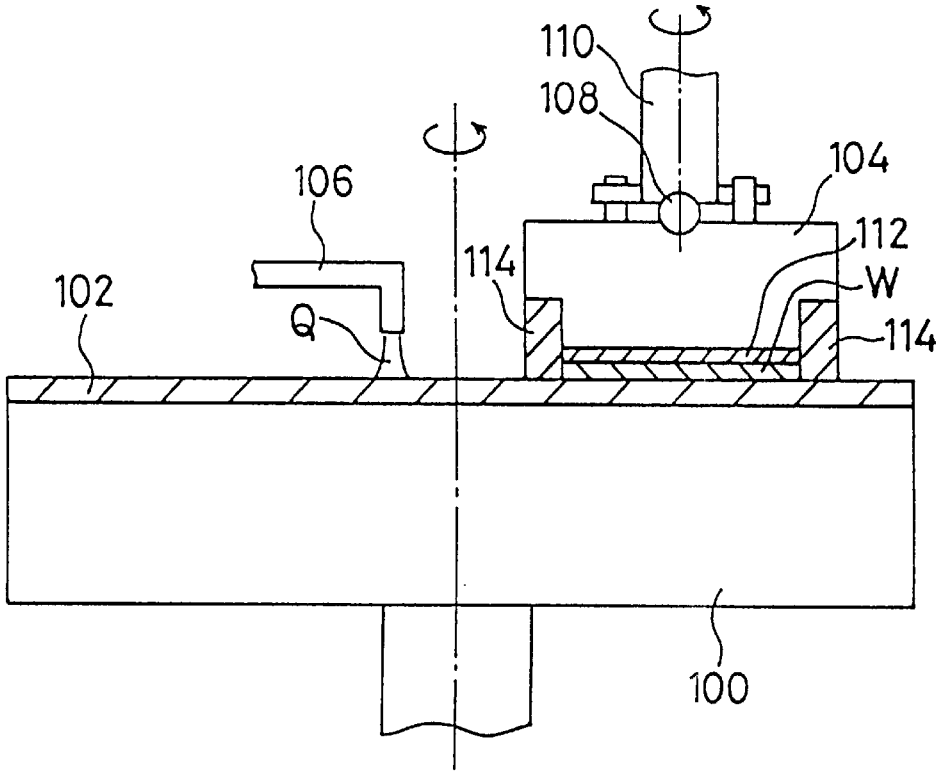
FIG. 17 PRIOR ART
FIG. 17 is a Vertical cross-sectional view showing a conventional polishing apparatus.
Figure 18:
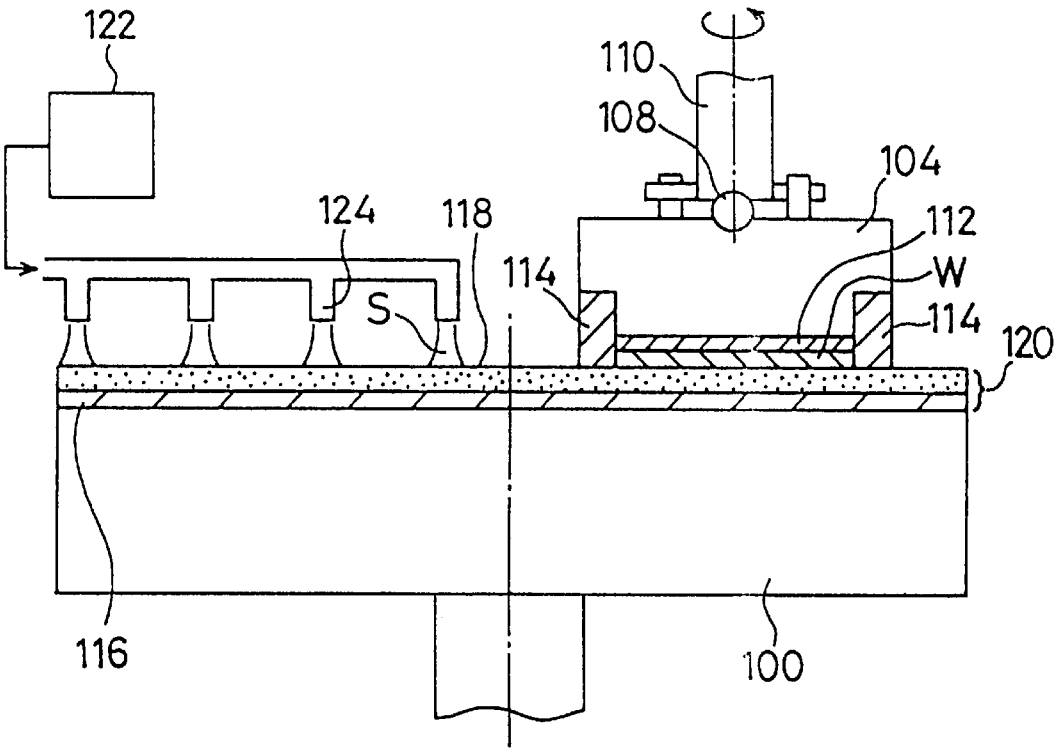
FIG. 18 PRIOR ART
FIG. 18 is a vertical cross-sectional view showing another conventional polishing apparatus.

FIGS. 14 through 16 show a polishing apparatus according to a fourth embodiment of the present invention. In the fourth embodiment, the polishing table 12 and the polishing surface 10 thereof make a circulative translational motion in a horizontal plane with respect, to the top rings 16, i.e., a scroll motion, for producing relative sliding movement between surfaces to be polished of semiconductor wafers W and the polishing surface 10. The top rings 16 bare mounted respectively on three parallel support arms 22 extending horizontally over the polishing table 12.

Each of the support arms 22 supports a single top ring 16, a motor for rotating the top ring 16, and an air cylinder for vertically moving the top ring 16. The top rings 16 are movable along the respective support arms 22 between a position over the polishing surface 10 and a position over a pusher 24 in the wafer transfer position near the polishing table 12. The polishing section A has three rotary transporters 26 in association with the respective top rings 16. Each of the rotary transporters 26 has two pushers 24. Each of the rotary transporters 26 is of a structure identical to the rotary transporter 26 shown in FIG. 1. However, the three rotary transporters 26 are rotatable in respective horizontal planes at different heights such that they do not interfere with each other, and hence can be rotated independently of each other.

A dresser 28 disposed alongside of the polishing table 12 is in the form of a roll having a length large enough to cover the polishing surface 10 diametrically. The dresser 28 is supported on rails 164 disposed on each side of the polishing table 12, and can be pressed against the polishing surface 10 and can make a reciprocating motion in a direction perpendicular to the axis of the dresser 28. A robot (fourth robot) 166 for delivering a semiconductor wafer W is movably disposed in a position facing the cleaning section B for selectively accessing three pushers 24 on the rotary transporters 26. The fourth robot 166 has a hand for holding a dry semiconductor wafer W and a hand for holding a wet semiconductor wafer W.

The cleaning section B and the loading/unloading section D of the polishing apparatus according to the fourth embodiment operate in the same manner as those of the polishing apparatus according to the first embodiment, but the polishing section A operates differently from that of the polishing apparatus according to the first embodiment. Specifically, the process of carrying an unpolished semiconductor wafer W with the second robot 38 to a position facing the polishing section A for delivering the unpolished semiconductor wafer W to the polishing section A is identical to the corresponding process carried out by the polishing apparatus according to the first embodiment.

The second robot 38 rotates so as to face the fourth robot 166 in the polishing section A, and transfers the semiconductor wafer W to the fourth robot 166. The fourth robot 166 moves to a position facing the rotary transporter 26 that is associated with the top ring 16 which is in a condition to be able to start a next polishing process earlier, and transfers the semiconductor wafer W to the pusher 24 on the rotary transporter 26 that is located in the wafer transfer position near the cleaning section B, i.e., the pusher 24 nearer the fourth robot 166.

When the polishing of one of the three semiconductor wafers W polished by the polishing surface 10 of the polishing table 12 is finished, only the top ring 16 holding the polished semiconductor wafer W is lifted and moved along the support arm 22 to a position above the pusher 24 located in the wafer transfer position near the polishing table on the rotary transporter 26 which corresponds to the top ring 16. The top ring 16 is then lowered by the air cylinder into abutment against the pusher 24, and transfers the polished semiconductor wafer W to the pusher 24. Then, the top ring 16 is lifted and waits in an upper standby position.

After receiving the polished semiconductor wafer W from the top ring 16, the rotary transporter 26 is turned 180° to locate the pusher 24 that has received the polished semiconductor wafer W at the wafer transfer position near the cleaning section B and locate the pusher 24 that carries a semiconductor wafer W to be polished at the wafer transfer position near the polishing table 12. The top ring 16 is lowered from the upper standby position, and receives under vacuum the semiconductor wafer W to be polished from the pusher 24. The top ring 16 holding the semiconductor wafer W to be polished moves along the support arm 22 until the top ring 16 is positioned over the polishing surface 10 of the polishing table 12. Thereafter, the top ring 16 is lowered by the air cylinder to press the surface to be polished of the semiconductor wafer W held by the top ring 16 against the polishing surface 10 under a predetermined pressure, and starts polishing the semiconductor wafer W.

Since the polishing table 12 and the polishing surface 10 thereof make a circulative translational motion in a horizontal plane with respect to the top rings 16, i.e., a scroll motion, relative sliding movement is produced between surfaces to be polished of semiconductor wafers W and the polishing surface 10, thereby polishing the semiconductor wagers W. If the polishing surface 10 is provided by a polishing cloth, then the polishing surface 10 is supplied with a polishing liquid (abrasive liquid) from the liquid supply nozzle 14 during the polishing process. If the polishing surface 10 is provided by the abrading plate 11, then the polishing surface 10 is supplied with pure water or a chemical solution from the liquid supply nozzle 14 during the polishing process.

After the polishing of a semiconductor wafer W is finished, the polished semiconductor wafer W is transferred from the top ring 16 to the rotary transporter 26, and an unpolished semiconductor wafer W is transferred from the rotary transporter 26 to the top ring 16. As the polishing of the semiconductor wafers W held by the three top rings 16 is finished, the polished semiconductor wafers W are successively transferred from the top rings 16 to the rotary transporter 26 and unpolished semiconductor wafers W are successively transferred from the rotary transporter 26 to the top rings 16. During this operation, the polished andy unpolished semiconductor wafers W are transferred between the rotary transporter 26 and the fourth robot 166. Specifically, the fourth robot 166 successively removes the polished semiconductor wafers W from the rotary transporter 26, and successively delivers the unpolished semiconductor wafers W to the rotary transporter 26.

The polished semiconductor wafer W removed from the rotary transporter 26 by the fourth robot 166 is then transferred from the fourth robot 166 to the second robot 38, which delivers the polished semiconductor wafer W to the cleaning section B for the cleaning process. At this time, the second robot 38 removes the polished semiconductor wafer W with its hand for holding a wet semiconductor wafer W, is turned 180°, and transfers the removed semiconductor wafer W to the second reversing machine 44.

Each time a predetermined number of semiconductor wafers W have been polished, all the top rings 16 are lifted, and the polishing surface 10 is dressed by the dresser 28. Specifically, the dresser 28 as it is pressed against the polishing surface 10 moves back and forth in directions perpendicular to the axis of the roll of the dresser 28, thereby dressing the polishing surface 10.

The process of cleaning the polished semiconductor wafers W in the cleaning section B and the subsequent processes are identical to the corresponding processes performed by the polishing apparatus according to the first embodiment.

In the fourth embodiment, the distances between the respective positions where the three top rings 16 are pressed against the polishing table 12, i.e., the polishing positions, and the center of the polishing table 12, i.e., the center of the polishing surface 10, are different from each other. If the polishing table 12 rotates about its own axis as in the case of the polishing apparatus according to the first and second embodiments, then since the relative speeds between the surfaces to be polished of the semiconductor wafers W held by the top rings 16 and the polishing surface 10 differ from each other because of the different positions of the top rings 16, periods of time required to polish the semiconductor wafers W to a desired finish also differ from each other. For this reason, the polishing table 12 should preferably make a circulative translational motion, i.e., a scroll motion, in order to uniformize the periods of time required to polish the semiconductor wafers W. However, inasmuch as the semiconductor wafers W are cleaned and otherwise processed one by one, if the number of polished semiconductor wafers W differs from top ring 16 to top ring 16, then the polishing table 12 may make a rotary motion.

If semiconductor wafers W are polished by the abrading plate 11 having the self-stop ability, i.e., if no further polishing takes place after the polishing surface 10 has polished the semiconductor wafers W to a certain level, then any difference between the polished levels of the semiconductor wafers W can be eliminated when the polishing table 12 makes a rotary motion with the top rings 16 arranged as shown in FIG. 16.

If the polishing table 12 makes a rotary motion to polish semiconductor wafers W, then since the dresser 28 can dress the polishing surface 10 in its entirety by moving the dresser 28 to the center of the polishing surface 10, the polishing surface 10 can be dressed while the semiconductor wafers W are being polished.

With the arrangement according to the present invention, as described above, since a plurality of substrates (workpieces) are simultaneously polished by the single polishing table, the throughput per unit installation area is greatly increased. Since the process of polishing respective substrates (workpieces) can individually be controlled, the substrates can uniformly be polished to a desired level without being polished excessively or insufficiently by individually controlling the process of polishing individual substrates.

Although certain preferred embodiments of the present invention have been shown and described in detail, it should be understood that various changes and modifications may be made therein without departing from the scope of the appended claims.

What is claimed is:

1. A polishing apparatus for polishing a surface of a workpiece, comprising:

a polishing table having a polishing surface thereon that defines a periphery;

plural workpiece holders for holding plural workpieces, respectively, and pressing the plural workpieces against said polishing surface, wherein said plural workpiece holders are arrangeable relative to one another in a first position such that when arranged in the first position said plural workpiece holders are positioned within the periphery defined by said polishing surface; and a controller for controlling said plural workpiece holders individually so that polishing parameters of said plural workpiece holders can be independently controlled.

2. The polishing apparatus according to claim 1, wherein said controller is for controlling said plural workpiece holders so as to be individually movable toward and away from said polishing surface.

3. The polishing apparatus according to claim 1, further comprising a detecting device associated with each of said plural workpiece holders, for detecting a condition of the workpiece which is being held by a respective one of said plural workpiece holders while the workpiece is being polished.

4. The polishing apparatus according to claim 3, wherein said detecting device is to detect formation of a liquid film between the workpiece and said polishing surface.

5. The polishing apparatus according to claim 1, further comprising a transfer device for transferring workpieces to and from said plural workpiece holders.

6. The polishing apparatus according to claim 5, wherein in said transfer device is to transfer one of the workpieces to and from one of said plural workpiece holders.

7. The polishing apparatus according to claim 5, wherein said transfer device is to transfer the workpieces all together to and from said plural workpiece holders.

8. The polishing apparatus according to claim 1, wherein said polishing table has, inwardly of said polishing surface, a surface at which no polishing is to occur.

9. The polishing apparatus according to claim 1, wherein at least one of said plural workpiece holders is to place a respective workpiece on a center of said polishing table for polishing the respective workpiece.

10. A polishing apparatus for polishing a surface of a workpiece, comprising:

a polishing table having a polishing surface thereon that defines a periphery, said polishing surface including a material that allows for self-generation of an abrasive during polishing; and plural workpiece holders for holding plural workpieces, respectively, and pressing the plural workpieces against said polishing surface, wherein said plural workpiece holders are arrangeable relative to one another in a first position such that when arranged in the first position said plural workpiece holders are positioned within the periphery defined by said polishing surface.

11. A polishing apparatus for polishing a surface of a workpiece, comprising:

a polishing table having a polishing surface thereon;

a plurality of workpiece holders each for holding a workpiece and pressing the workpiece against said polishing surface; and a noncontact bearing for supporting said polishing table in a noncontact manner while controlling an attitude thereof.

12. A polishing apparatus for polishing a surface of a workpiece, comprising:

a polishing table having a polishing surface thereon;

a plurality of workpiece holders each for holding a workpiece and pressing the workpiece against said polishing surface; and a controller for controlling speeds of movement of said plurality of workpiece holders toward and away from said polishing surface depending on a distance between a surface of a respective workpiece and said polishing surface.

13. The polishing apparatus according to claim 12, wherein said plurality of workpiece holders are arrangeable relative to one another in a first position such that when arranged in the first position said plurality of workpiece holders are positioned within a periphery defined by said polishing surface.

14. A polishing apparatus for polishing a surface of a workpiece, comprising:

a polishing table having a polishing surface thereon;

a plurality of workpiece holders each for holding a workpiece and pressing the workpiece against said polishing surface;

a feed robot for feeding workpices to and from said plurally of workpiece holders;

a reversing machine for reversing workpieces;

a rotary transporter for rep lacing workpieces; and a self-cleaning mechanism for cleaning said robot, said reversing machine, and said rotary transporter depending on a polishing process.

15. The polishing apparatus according to claim 14, wherein said plurality of workpiece holders are individually movable toward and away from said polishing surface.

16. The polishing apparatus according to claim 14, further comprising a detecting device associated with each of said plurality of workpiece holders, for detecting a condition of the workpiece which is being held by a respective one of said plurality of workpiece holders while the workpiece is being polished.

17. The polishing apparatus according to claim 14, wherein said plurality of workpiece holders are arrangeable relative to one another in a first position such that when arranged in the first position said plurality of workpiece holders are positioned within a periphery defined by said polishing surface.

18. A polishing apparatus for polishing a surface of a workpiece, comprising:

a polishing table having a polishing-surface thereon; and a plurality of workpiece holders each for holding a workpiece and pressing the workpiece against said polishing surface;

wherein said polishing table is constructed and arranged to make a circulative translational motion in a horizontal plane with respect to said plurality of workpiece holders.

19. The polishing apparatus according to claim 18, wherein said plurality of workpiece holders are individually movable toward and away from said polishing surface.

20. The polishing apparatus according to claim 18, further comprising a detecting device associated with each of said plurality of workpiece holders, for detecting a condition of the workpiece which is being held by a respective one of said plurality of workpiece holders while the workpiece is being polished.

21. The polishing apparatus according to claim 18, wherein said plurality of workpiece holders are arrangeable relative to one another in a first position such that when arranged in the first position said plurality of workpiece holders are positioned within a periphery defined by said polishing surface.

* * * * *